US007744497B2

(12) United States Patent
Phelan, Jr.

(10) Patent No.: US 7,744,497 B2
(45) Date of Patent: Jun. 29, 2010

(54) SWINGING IMPLEMENT

(75) Inventor: Gerald L. Phelan, Jr., St. Louis, MO (US)

(73) Assignee: Giant Project, Inc, St. Louis, MO (US)

( * ) Notice: Subject to any disclaimer, the term of this patent is extended or adjusted under 35 U.S.C. 154(b) by 97 days.

(21) Appl. No.: 12/063,292

(22) PCT Filed: Aug. 9, 2006

(86) PCT No.: PCT/US2006/031237

§ 371 (c)(1),
(2), (4) Date: Mar. 29, 2008

(87) PCT Pub. No.: WO2007/019566

PCT Pub. Date: Feb. 15, 2007

(65) Prior Publication Data

US 2008/0200288 A1 Aug. 21, 2008

Related U.S. Application Data

(60) Provisional application No. 60/706,283, filed on Aug. 9, 2005, provisional application No. 60/734,059, filed on Nov. 7, 2005.

(51) Int. Cl.
*A63B 69/00* (2006.01)
*A63B 59/00* (2006.01)

(52) U.S. Cl. ..... 473/457; 422/564; 422/568

(58) Field of Classification Search ..... 473/422, 473/451, 457, 523, 538, 564, 568, 565, 526, 473/549, 552, 204, 201; D21/753
See application file for complete search history.

(56) References Cited

U.S. PATENT DOCUMENTS

| | | | | | |
|---|---|---|---|---|---|
| 2,084,591 | A | * | 6/1937 | Pardoe | 473/204 |
| 2,394,184 | A | * | 2/1946 | Janis | 473/520 |
| 2,659,605 | A | * | 11/1953 | Letourneau | 473/568 |
| 2,798,292 | A | * | 7/1957 | Bishaf | 30/318 |
| 2,984,486 | A | * | 5/1961 | Jones | 473/568 |
| 3,104,876 | A | * | 9/1963 | Salsinger | 473/568 |
| 3,129,003 | A | * | 4/1964 | Mueller et al. | 473/568 |
| 3,554,545 | A | | 1/1971 | Mann | |
| 4,147,348 | A | * | 4/1979 | Lee | 473/526 |

(Continued)

OTHER PUBLICATIONS

Dwyer, "Bat Boy" St. Louis Business Journal (Apr. 21, 2006) 2 pages, http://stlouis.bizjournals.com/stlouis/stories/2006/04/24/tidbits1.html.

*Primary Examiner*—Mitra Aryanpour
(74) *Attorney, Agent, or Firm*—Bryan Cave LLP

(57) ABSTRACT

A swing implement, such as a baseball bat (9), adapted for gripping by the hands of a user having a support surface (10) between the knob (20) and the handle (30) of the swinging implement. The support surface provides a gradual transition between the knob and the handle. The support surface supports the hand of the user while gripping the swinging implement. Another swinging implement (10) comprises a support surface extending at a shallow angle from the handle between the handle and the end surface of the knob for supporting the hand of the user while gripping the swinging implement. A support sleeve (6*c*) adapted to cooperate with a handle and knob of a conventional baseball bat including a support surface for providing added support for the hands of a user gripping the bat.

9 Claims, 20 Drawing Sheets

U.S. PATENT DOCUMENTS

| | | | | | |
|---|---|---|---|---|---|
| D263,863 | S | | 4/1982 | Golab | |
| D273,759 | S | * | 5/1984 | Drori | D8/75 |
| 4,565,367 | A | * | 1/1986 | Kaiser | 482/131 |
| 4,653,754 | A | * | 3/1987 | Cross | 473/568 |
| 5,088,733 | A | * | 2/1992 | Barnea et al. | 473/568 |
| 5,482,072 | A | * | 1/1996 | Cimino | 135/72 |
| 5,792,002 | A | * | 8/1998 | Bothwell | 473/316 |
| 5,979,015 | A | | 11/1999 | Tamaribuchi | |
| 6,004,234 | A | * | 12/1999 | Majchrowicz | 473/560 |
| D444,834 | S | * | 7/2001 | Tucker, Sr. | D21/753 |
| 6,500,079 | B1 | * | 12/2002 | Tucker, Sr. | 473/513 |
| 6,752,731 | B1 | * | 6/2004 | Kramer | 473/568 |
| 2004/0147345 | A1 | * | 7/2004 | Michelet et al. | 473/398 |
| 2004/0162168 | A1 | * | 8/2004 | Ginkel | 473/564 |
| 2005/0124442 | A1 | * | 6/2005 | Wells et al. | 473/564 |
| 2005/0202910 | A1 | * | 9/2005 | Blount | 473/568 |

* cited by examiner 9
11
10
20a 13
30

15
40

Fig. 14
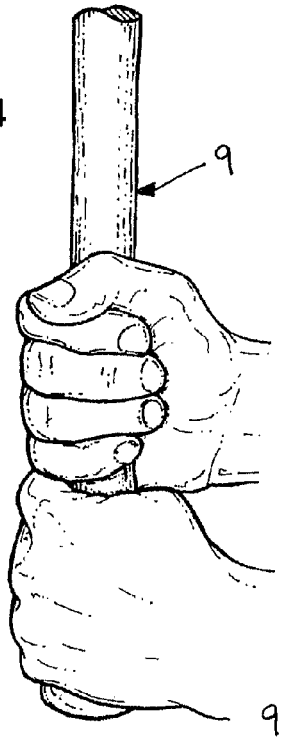
Fig. 15
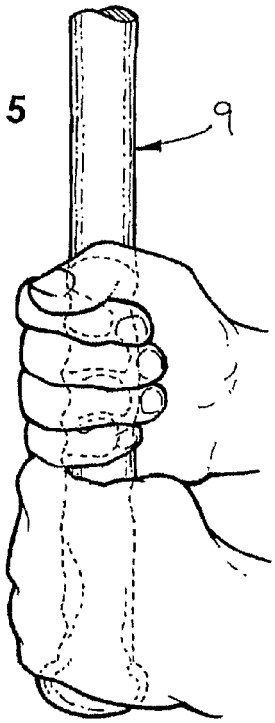
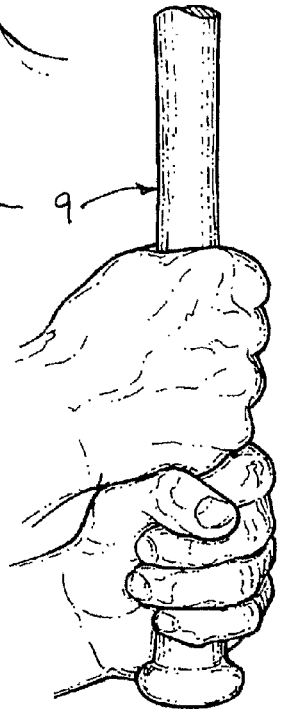
Fig. 16
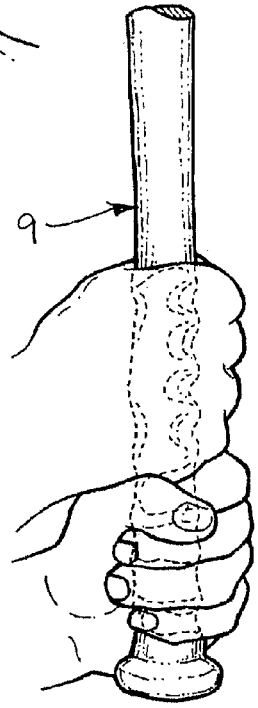
Fig. 17

SWINGING IMPLEMENT

REFERENCE TO RELATED APPLICATIONS

This application is a U.S. National application based on PCT/US2006/031237 filed Aug. 9, 2006, which claims priority to U.S. provisional patent applications Ser. No. 60/706,283 filed Aug. 9, 2005 and Ser. No. 60/734,059 filed Nov. 7, 2005.

FIELD OF INVENTION

The present invention relates to swinging implements (e.g., baseball bats) having ergonomic handles and knobs, and methods of making the swinging implements.

DESCRIPTION OF RELATED ART

Baseball bats are well known in the art. For example, baseball bats can be turned from a single hard-wood billet, either composite or solid, or from a composite assembly of wood, having a round cylindrical barrel, tapering down to a smaller diameter handle then slightly tapering up to a greater diameter knob at the handle end. The knob is intended to prevent the bat from slipping from the hands of a batter during a swing. This configuration has been the standard of Major League Baseball (MLB) and other baseball governing bodies for quite some time. In another example, baseball bats of similar shape and size are constructed of other materials, such as metal (e.g., aluminum), and combinations of materials. The present invention may be applied to baseball bats constructed in any manner from any material, or materials.

In recent times, batters have been specifying thinner bat handles with tapered-out knobs rather than handles ending with a more abrupt transition from handle to knob. The construction of thinner handles and tapered knobs is thought to be at least partially responsible for bats breaking off just above the hands and slipping from the batter's hands during the swing, even with batting gloves designed to increase batter grip.

Recently, Major League Baseball mandated that bat manufacturers carry a substantial insurance policy to cover potential legal actions resulting from a bat leaving the playing field, either from slipping from the hands of the batter or breaking, which may result in hitting and injuring a fan, bystander, or player. When a bat breaks, typically it is either from striking a pitched ball on the free end of the bat, from striking a pitched ball too close to the handle, or from improper alignment of the hands with the grain of the bat. In some instances of broken bats, the estranged bat barrel can be propelled past the base paths on the field or even into the stands. In some cases the broken end of the barrel can be sharp and pointed, making it a dangerous projectile in the field of play, sidelines, and stands. For example, right-handed batters may accidentally lose their grip and throw a bat down the third base line when swinging for and missing a pitch. In another example, right-handed batters may accidentally lose their grip and throw a bat down the first base line after swinging for an outside pitch where they reach, or fully extend their arms. Left-handed batters operate generally as a mirror image, accidentally throwing bats in the alternate direction of right-handed batters.

Solutions to increase the effective grip of a bat, which have been employed and are known in the art, include wrapping the handle with various kinds of tapes, and molded substances, rubbing the handle with pine tar, or other sticky substances, covering the handle with chemical compounds mixed with various durable abrasives, and wearing batting gloves with various gripping properties. While there are many applications to improve grip, few solutions include actual structural changes to the bat handle. In one case, Stan Musial of the St. Louis Cardinals baseball club, from 1941 to 1963, cut parallel grooves into the handle of his baseball bat to improve grip and performance, resulting in a non-smooth bat handle. This practice was accepted by MLB and never challenged by officials. According to the rules of MLB, reproduced in part below, the handle is the only part of the bat that can be covered or treated to improve grip.

Although MLB infrequently approves baseball bat design innovations, the most recent innovation approved for use by baseball regulating organizations in bat evolution is the "cupping" of the end of the bat, also covered in the Major League Baseball Bat regulations reproduced in part below. This innovation is employed to reduce barrel weight of the bat, extend the length of the "sweet spot" of the hitting area of the bat, and decrease the weight of the barrel from the "cupping," resulting in increased bat-speed and thus driving the pitched ball with more force.

Professional-level baseball players commonly have their baseball equipment custom made by the manufacturer to their specific preferences of fit, color, finish, features, and their own physical attributes. The equipment being tailored to the player includes gloves, shoes, uniforms, and bats. The variables available to batters in bat configuration include, color, barrel size, length, weight, taper of handle, and taper of knob. Each manufacturer of bats has slight variations in the final bat product, including the way the wood is chosen, graded, dried, tested, and finished.

Moreover, many major manufacturers of bats are focused on developing technologies for metal alloy bats and composite wood bats, rather than working within the current rules structure, to develop innovations to the solid composite or one-piece baseball bat. With the evolution of new technologies in three-dimensional imaging and four-point milling, new improvements in shaping and turning of baseball bats are possible.

In at least one alternate embodiment of this invention, an implement may be constructed to maintain conformity to the core intent of United States baseball rules and regulations, known in the art, regarding the manufacture of solid, single piece, wood bats and composite bats required and proposed for use in many levels of baseball play. The Major League Baseball Bat Regulations state, in part, as follows:

Major League Baseball Bat Regulations 1.10

(a) The bat shall be a smooth, round stick not more than 2¾ inches in diameter at the thickest part and not more than 42 inches in length. The bat shall be one piece of solid wood. NOTE: No laminated or experimental bats shall be used in a professional game (either championship season or exhibition games) until the manufacturer has secured approval from the Rules Committee of his design and methods of manufacture. (b) Cupped Bats. An indentation in the end of the bat up to one inch in depth is permitted and may be no wider than two inches and no less than one inch in diameter. The indentation must be curved with no foreign substance added. (c) The bat handle, for not more than 18 inches from its end, may be covered or treated with any material or substance to improve the grip. Any such material or substance, which extends past the 18-inch limitation, shall cause the bat to be removed from the game. NOTE: If the umpire discovers that the bat does not conform to (c) above until a time during or after which the bat has been used in play, it shall not be grounds for declaring the batter out, or ejected from the game. (d) No colored bat may be used in a professional game unless approved by the Rules Committee.

SUMMARY

Aspects of this invention address the shortcomings currently existing with baseball bats described above. These shortcomings include the grip, safety, and responsiveness provided by the current art of bat design and construction. Because every batter has their own bat size and shape preference, method of gripping a bat, and further preferences (e.g., differently size hands, knuckles, and fingers), many batters would prefer and/or benefit from a bat handle configured to their individual ergonomic attributes, method of gripping the bat, and swing. Embodiments of the invention include several features, including methods for capturing a batter's anatomical grip pattern. Such anatomical grip patterns may be either batter-specific or of general use for many batters. Other embodiments of the invention are further directed to the manufacture of a baseball bat with a grip that is ergonomically designed to be superior to the existing art. One embodiment of the invention displaces the cubic volume of a thicker, more substantial bat handle to accommodate a batter's natural ergonomic grip, without thinning the handle beyond the structural integrity of the bat handle.

Unlike other ergonomic grip applications known in the art, this invention is uniquely applied to handles for bats, clubs, and implements for use in baseball, cricket, golf, and the like where the bat or club is gripped not in the palm of the hand but rather with the fingers.

In another embodiment of the invention, a process first captures the inverse anatomical shape of a batter's grip by employing a bat on which a narrow dowel handle is covered with a moldable, clay-like material. The batter's hands grip the bat in proper alignment with the grain of the bat, as known in the art. The grip of the hands is held firm until the gripped handle is held comfortably by the batter, resulting in a molded bat handle model. This molded handle model is used as the master model and is applied to a pre-milled bat created with a larger diameter handle than a standard blank bat handle. The remainder of the bat handle and barrel has already been turned, as known in the art, to form the final barrel and initial taper leading to the handle. Using existing digital three-dimensional image capturing technology, known in the art, a three-dimensional image of the molded handle is imported into a CAD-CAM program, as known in the art, which is converted into a three-dimensional digital model. The digital three-dimensional model is then mapped, as known in the art, to the partially turned bat with an un-milled/unfinished bat handle. The mapped image is then milled, using four-point milling, as known in the art, from the unfinished handle, resulting in an ergonomic baseball bat handle that ergonomically matches the batter's unique hand grip and properly aligns the batter's hands with the grain of the bat.

Unlike standard bat handles, which are round and smooth and sometimes covered with grip enhancements, this ergonomic bat grip exactly interlinks with the fingers and folds of the batter's hands. This substantially increases the surface area contacting the batter's hands over a standard bat handle. This increased surface area contact with the bat handle results in the following beneficial results:

improved grip of the bat by the batter's hands;

reduced likelihood of a bat slipping from the batter's hands during a swing in a game, practice, or warm-up;

improved responsiveness of the bat in the hands of the batter;

proper alignment of the batter's hands with the horizontal axis of the wood grain of the bat; and improved grip comfort.

Added considerations of ergonomics are employed in embodiments of this invention by removing a portion of the conventional knob of the bat and smoothing the transition between the handle and the removed portion of the knob, thereby creating a slight concave space for the palmaris brevis and abductor digiti minimi muscles of the bottom gripping hand in the knob at the end of the bat handle. During the swing of a typical baseball bat, the wrists roll during the swing, top hand over bottom hand, just prior to making contact with the ball. During this roll of the wrists, the knob of a conventional baseball bat, which has a larger diameter than the bat handle, severely presses into the palmaris brevis and abductor digiti minimi muscles of the hand. Without being bound to any particular theory, it is believed that this pressure decreases the ability of the palmaris brevis and abductor digiti minimi muscles to maintain themselves it their contracted, or shortened, states, because the knob presses into the muscles, thereby increasing their respective lengths and decreasing their ability to maintain their contracted state. This decrease in muscle contraction may cause the batter to loosen his supporting grip of the bat handle. The resulting de-stabilized grip of the bottom hand increases the probability that the bat will slip from the hands of the batter during the swing. A manifestation of this knob phenomenon is demonstrated by empirical evidence showing that batters often wear out their batting glove on the bottom hand palm first. This wear is caused by the knob constantly rubbing the palmaris brevis and abductor digiti minimi muscles during each swing.

In contrast, it is believed that embodiments of this invention allow for much improved grip stability and increased accuracy through all phases of the swing of the bat because the smooth transition between the handle and knob cooperate to evenly support the palmaris brevis and abductor digiti minimi muscles, rather than destabilizing the muscles as with conventional knobs.

One or more embodiments of this invention provide for custom milling of the handle-end of the wood bat to precisely match the unique grip of either a specific batter or a general group of batters.

Other embodiments of this invention provide for a substantially improved batter grip to inhibit the bat from slipping from a batter's grasp during or after a swing of the bat.

Still other embodiments of the invention increase the surface area of the bat handle contacting the hands of the batter to provide more responsive performance and accurate placement of the bat during the swinging motion.

Other embodiments of the invention reduce the vibration felt by a batter (e.g., when a baseball is struck either to close to the handle or too close to the end of the bat).

Various refinements exist of the features noted in relation to the above-mentioned aspects of the present invention. Further features may also be incorporated in the above-mentioned aspects of the present invention. These refinements and additional features may exist individually or in any combination. For instance, various features discussed below in relation to any of the illustrated embodiments of the present invention may be incorporated into any of the above-described aspects of the present invention, alone or in any combination.

BRIEF DESCRIPTIONS OF THE DRAWINGS

Many of the drawings included herein are those of a right-handed grip and resulting ergonomic handle. As would be understood by one skilled in the art, the processes, embodiments, and resulting bats of the present invention may be applied to bats for left-handed batters as well. For simplicity, many of the figures and much of the description are directed to bats positioned for a right-handed batter, but are readily applicable to a left-handed batter.

FIG. 14 is an enlarged, fragmentary, front perspective of a batter's hands gripping the embodiment of FIG. 1;

FIG. 15 is an enlarged, fragmentary, front perspective of the bat of FIG. 14 with the obstructed portions of the baseball bat shown as hidden;

FIG. 16 is a rear perspective of the embodiment of FIG. 14;

FIG. 17 is a rear perspective of the bat of FIG. 15;

Corresponding parts are designated by corresponding reference numbers throughout the several views of the drawings.

DETAILED DESCRIPTION

Figures 1, 2, 3:
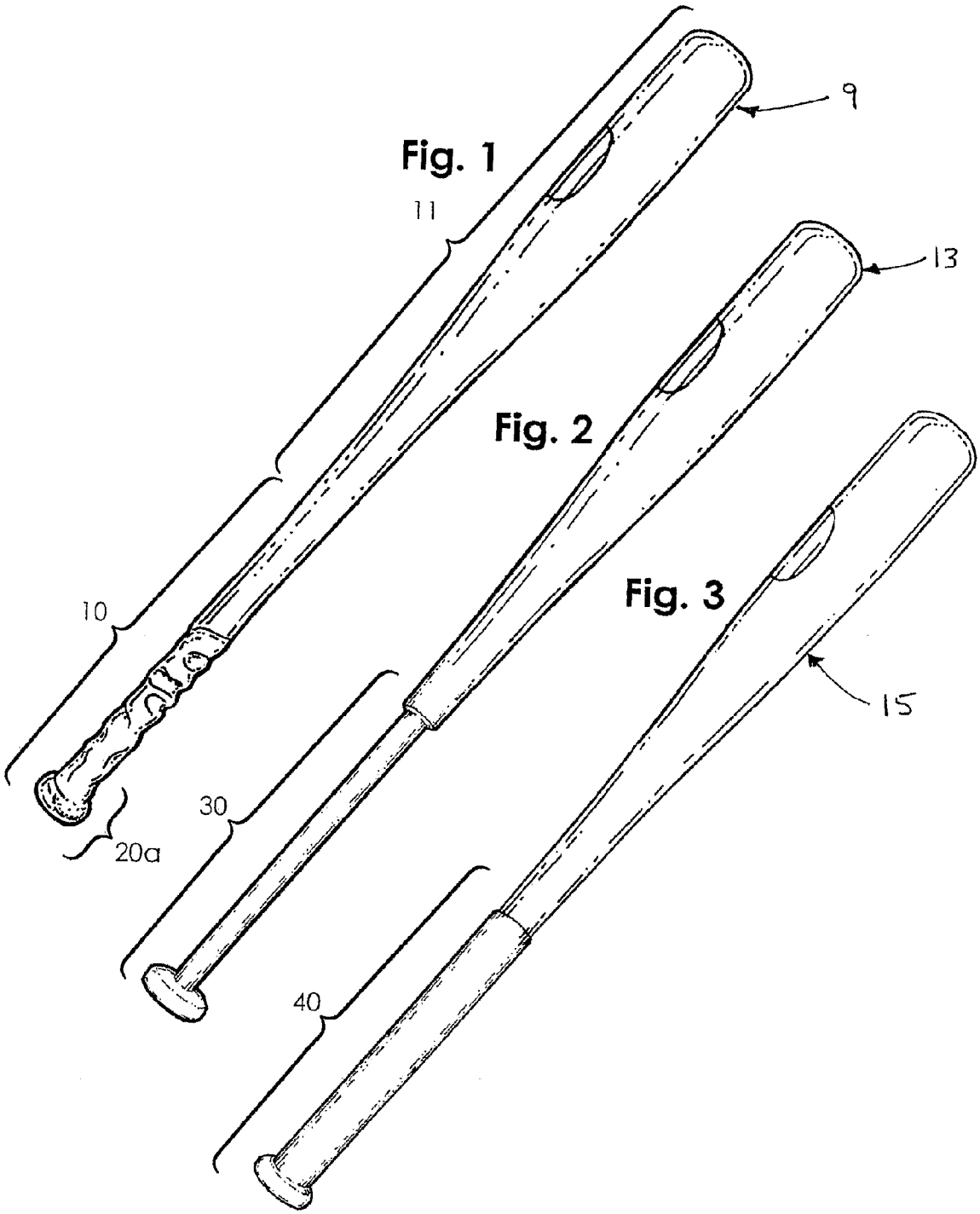
FIG. 1 is a front perspective of a first embodiment of the baseball bat with an ergonomic handle.
FIG. 2 is a front perspective of the first embodiment of the molding-handled bat.
FIG. 3 is a front perspective of the first embodiment of the pre-milled baseball bat with turned barrel and unfinished handle.

With reference to the drawings, the invention will now be described in detail. In general, the invention depicted in FIG. 1 is a wooden baseball bat, generally indicated 9, formed from a single billet and having an ergonomic grip 10. The billet may be formed from a variety of materials, including solid natural wood, composite wood, laminated wood, or synthetic wood. The bat 9 may alternately be formed from or include other materials, such as metal (e.g., aluminum), without departing from the scope of the present invention.

To create the bat 9 of FIG. 1, two stages of bat creation are depicted in FIGS. 2 and 3. A molding bat, generally indicated 13 in FIG. 2, is used to capture the grip pattern of a batter's hands, as discussed in greater detail below. A pre-milled baseball bat, generally indicated 15 in FIG. 3, may then be milled (e.g., with 4-point milling technology) to match the captured grip pattern of the batter's hands to form the final ergonomic grip, or handle, or the baseball bat. The details of this process are described in detail below.

Figure 12:
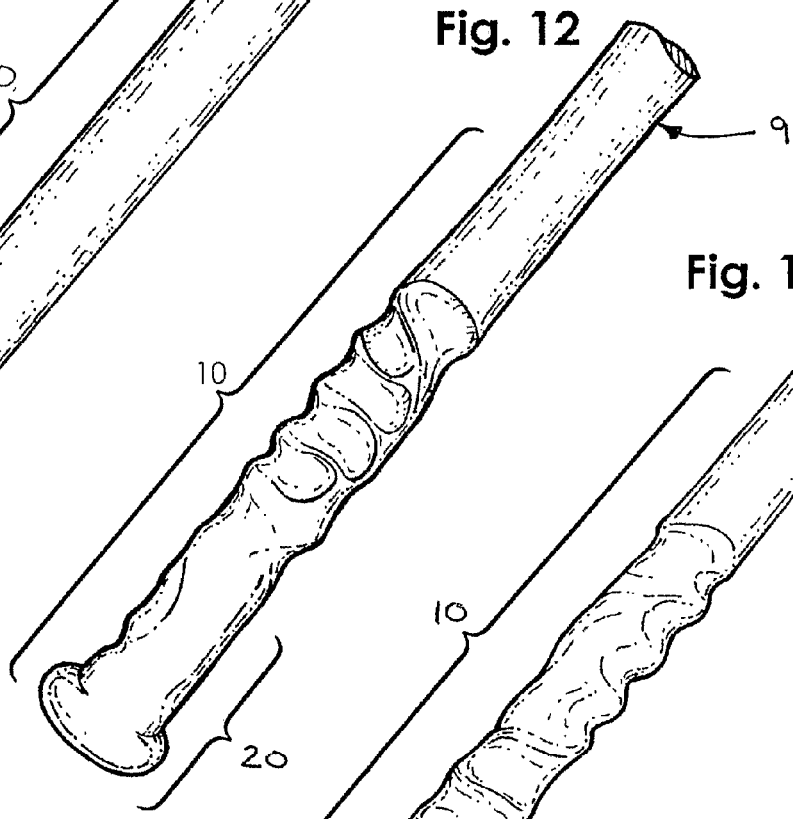
FIG. 12 is an enlarged, fragmentary, front perspective of the bat of FIG. 1.
Figure 13:
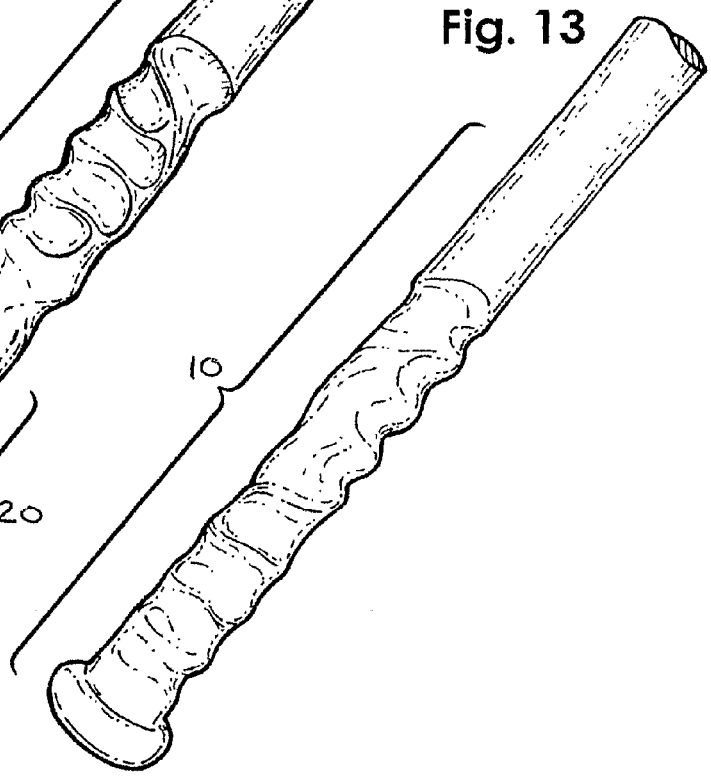
FIG. 13 is an enlarged, fragmentary, rear perspective of the embodiment of FIG. 1.
Figure 18:
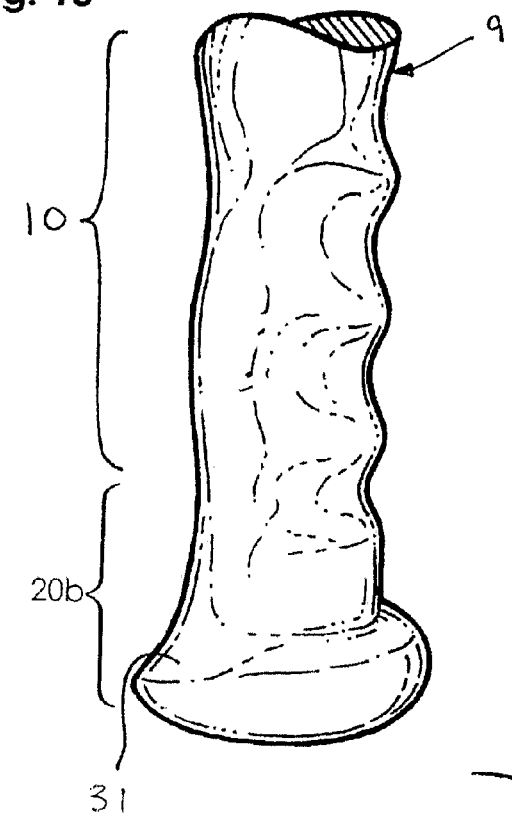
FIG. 18 is an enlarged, fragmentary, right perspective of the embodiment of FIG. 1.
Figure 19:
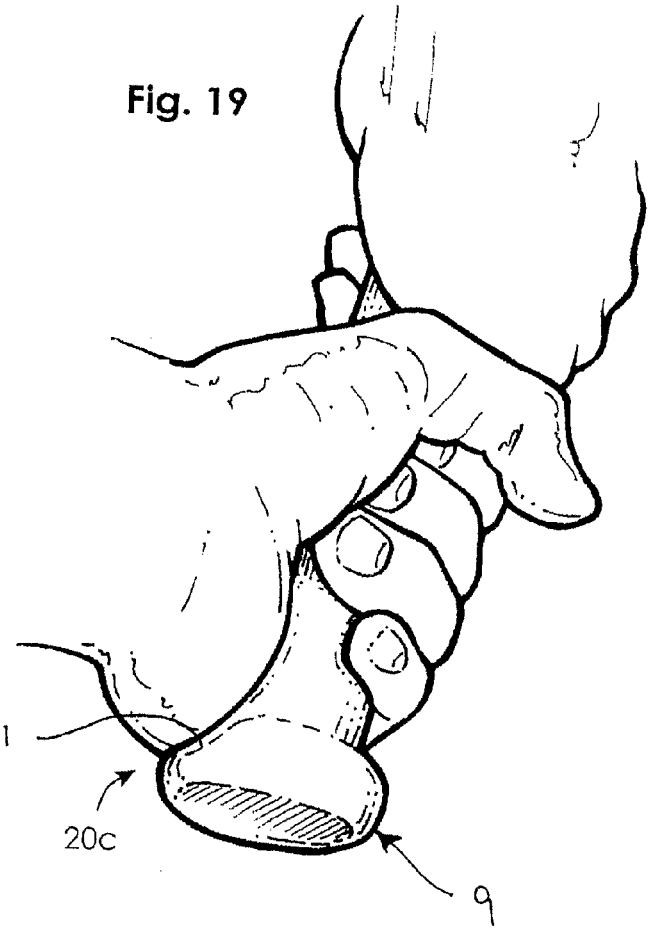
FIG. 19 is an enlarged, fragmentary, rear perspective of a batter's hands gripping the embodiment of FIG. 1.

The details of the ergonomic grip 10 of the bat 9 are shown in detail in FIGS. 12 and 13, illustrating the front and rear sides of the right-handed ergonomic grip. Details of optional knobs 20 (e.g. 20*b* and 20*c*) of the ergonomic grip 10 are shown in FIGS. 18 and 19, and discussed in greater detail below. As noted above, one embodiment of the invention comprises a bat formed from a single unit of wood, either composite, laminate, or otherwise, resulting in a single billet, which is turned to form a single pre-milled bat handle 40, as illustrated in FIG. 3, where the handle is unfinished and prepared to be milled to match the model of a batter's grip (see discussion below relating to FIG. 9).

Figure 10:
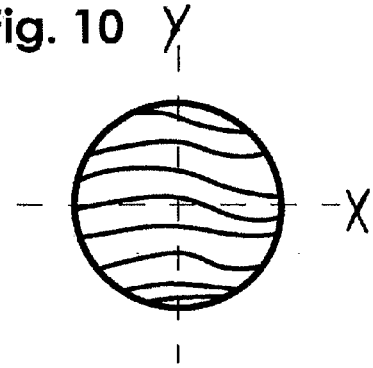
FIG. 10 is a section of a typical wooden baseball bat showing the grain of the wood generally following the x-axis.

The particular external shape of the barrel 11 of the bat 9 including the taper, diameter, and length is a matter of choice on behalf of the batter as it relates to the rules and guidelines of various baseball governing bodies. The grip of the batter on the bat 9 is typically aligned with the grain of the wood such that when in use, the x-axis, as illustrated in FIG. 10, of the bat will contact the baseball during the swing.

Figure 4:
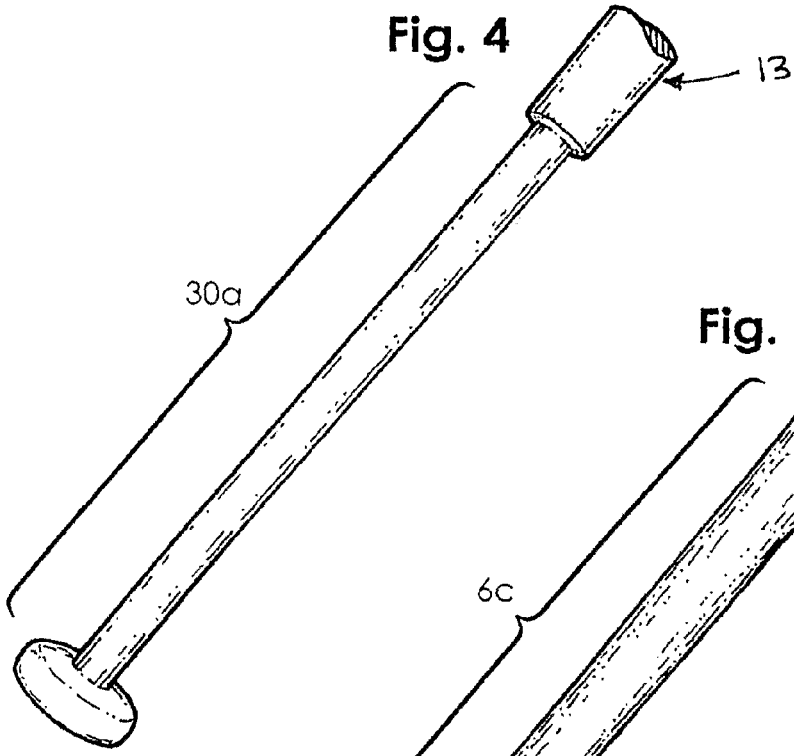
FIG. 4 is an enlarged, fragmentary, front perspective of the embodiment of FIG. 2.
Figure 5:
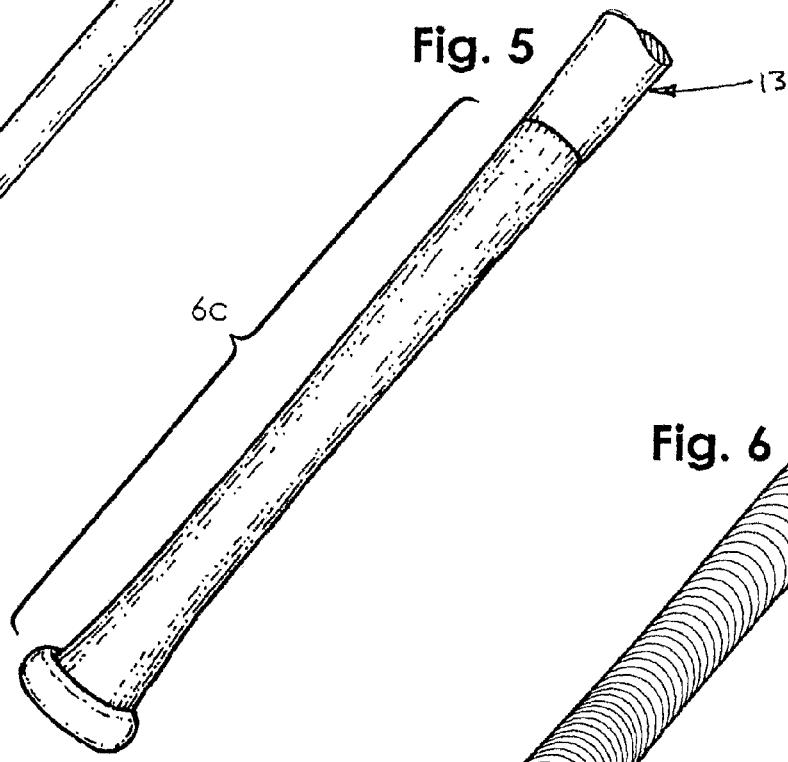
FIG. 5 is an enlarged, fragmentary, front perspective of the embodiment of FIG. 4 with a moldable substance applied.
Figure 6:
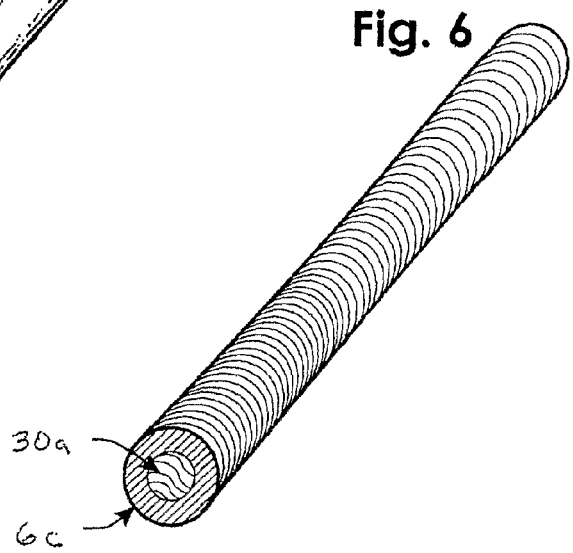
FIG. 6 is an enlarged, fragmentary, end perspective of the embodiment of FIG. 5, with portions removed to reveal the wood core of FIG. 4 and the moldable substance applied as in FIG. 5.

Referring now to FIGS. 2 and 4, the molding bat 13 is turned like a standard bat with the handle section 30, 30*a* (broadly, handle) turned to a small, consistent-diameter dowel. A moldable clay-like material 6*c* is applied around the core handle 30, 30*a* to a thickness consistent with the batter's preference of a bat handle size and taper. FIG. 6 shows a fragmentary, end perspective of the core handle section 30*a* surrounded by the moldable material 6*c*.

Figure 7:
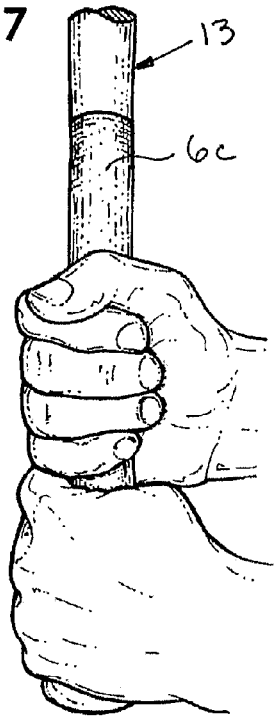
FIG. 7 is an enlarged, fragmentary, front perspective of a batter's hands applying grip pressure to the embodiment of FIG. 5 to form the mold model.
Figure 8:
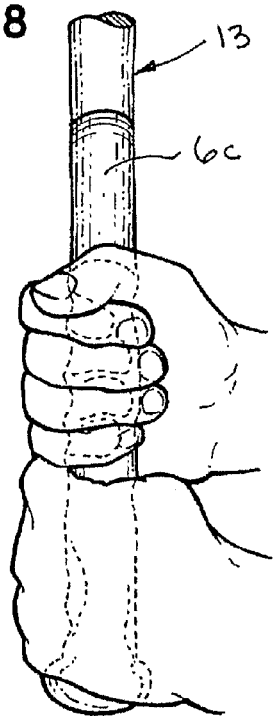
FIG. 8 is an enlarged, fragmentary, front perspective of the mold model of FIG. 7 with the obstructed portions of the mold model shown as hidden.
Figure 9:
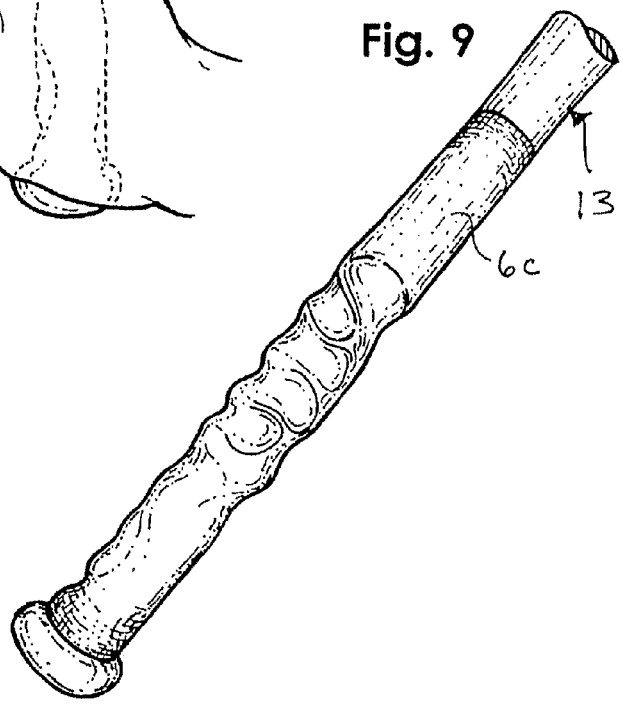
FIG. 9 is an enlarged, fragmentary, front perspective of the resulting mold model from FIG. 7.

After the moldable material 6*c* is applied, the molding bat 13 is ready to capture the batter's grip, as shown in FIGS. 7 and 8. The batter firmly grasps the handle 30 of the molding bat 13 in alignment with the grain of the bat. The batter grips the molding bat 13 until the moldable material 6*c* molds to the batter's preferred hand position, as illustrated in FIG. 9. As shown in FIGS. 7-9, the clay-like, moldable material 6*c* fills the folds and bends of the batter's hands so that the molding bat 13 perfectly interlinks with the batter's fingers and hands.

Referring to FIGS. 18 and 19, the position and location of the bottom gripping hand (the left hand in FIG. 19) is noted such that the knob 20*b*, 20*c* of the bat 9 can be milled to remove a portion of the conventional knob of the bat. The transition between the grip 10 and the removed portion of the knob can be smoothed (by removing more or less material) to create a support surface 31 to support and alleviate pressure on the palmaris brevis and abductor digiti minimi muscles of the bottom gripping hand. Without being bound to any particular theory, it is believed that a conventional bat knob may destabilize these muscles, by protruding out from the handle of the bat at a location impacting the batter's grip. With the present invention, however, the support surface 31 and knob 20*b*, 20*c* cooperate to support these muscles. This results in improved grip stability by allowing the palmaris brevis and the abductor digiti minimi muscles to smoothly flow (i.e., remain contracted and uncompressed) through a swing of the bat 9 without being severely pressed by the knob 20*c* of the bat. Thus, grip strength is maintained throughout the swing.

More particularly, with a conventional bat having a typical knob, the destabilizing mechanics of a typical grip and swing occur as follows. First, the batter grips the bat so that the fifth digit (i.e., the pinky) wraps around the bat and is butted up against the abrupt transition between the bat handle and the knob, while the heel of the palm of the hand presses firmly against the knob. The batter adjusts the position of the bat to an upright, or ready, position and prepares for swinging the bat. At this point, the batter's wrists and forearms are substantially perpendicular to the handle of the bat. When the swing begins, the hands begin to move forward toward the incoming ball with little change to the relationship of hands, wrists, and forearms relative to the bat handle. As the hands move around the batter toward the front of the batter's body, the batter extends the bat outward and laterally away from the body, positioning the wrists in an ulnar deviation. It is at this point that the knob of a conventional bat begins to compress the palmaris brevis and the abductor digiti minimi muscles. As the barrel of the bat crosses the plate and midline of the batter, the top hand gripping the bat begins to roll over the bottom hand while both wrists increase their ulnar deviation, further exerting pressure on the palmaris brevis and the abductor digiti minimi muscles. At this point in the swing, the centripetal forces exerted on the bat by the batter to keep the bat moving in its arcuate path around the batter further increase knob pressure on the palmaris brevis and the abductor digiti minimi muscles. As the bat reaches optimal striking position with the ball, the top hand continues to roll over the bottom hand, thereby maximizing the forces exerted on the palmaris brevis and the abductor digiti minimi muscles. At this point in the swing, potential grip failure is at its peak. Potentially forcing the grip to fail while either reaching for an outside pitch, thereby releasing the bat down the opposite field from the batter, or missing the ball, thereby releasing the bat down the pull-side of the field.

Once the batter is satisfied with the shape of the moldable material 6*c* of the grip, a three-dimensional image of the moldable material is captured using three-dimensional photography, as known in the art. The captured image is then mapped to a pre-milled bat handle 40 (see FIG. 3) on the milling machine such that the x-axis of the wood of the pre-milled bat 15 and the molding bat 13 are properly aligned with each other.

Figure 11:
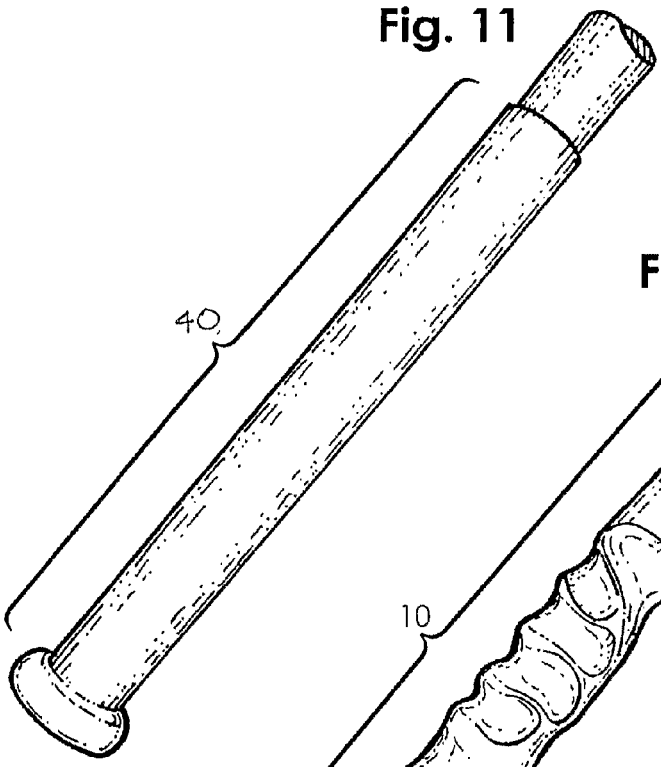
FIG. 11 is an enlarged, fragmentary, front perspective of the bat of FIG. 3.

Using 4-point milling, as known in the art, the three-dimensional image map is milled into the handle 40 (see FIGS. 3 and 11), resulting in the bat 9 embodiment of FIGS. 1 and 12-19, with ergonomic grip 10 and knob 20.

As would be understood by one skilled in the art, not all features of the exemplary bat 9 of FIGS. 1 and 12-19 or the other embodiments disclosed herein need be present in one particular bat to embody features of the present invention. In particular, the various features discussed herein in relation to any of the illustrated embodiments of the present invention may be incorporated into any other embodiments of the invention, alone or in any combination. For example, one exemplary bat may include the ergonomic grip 10 without the support surface 31, without departing from the scope of the claimed invention. In another example, a bat may include the support surface 31 without the ergonomic grip 10, without departing from the scope of the claimed invention. Other combinations of features are also contemplated as within the scope of the claimed invention.

Figure 20:
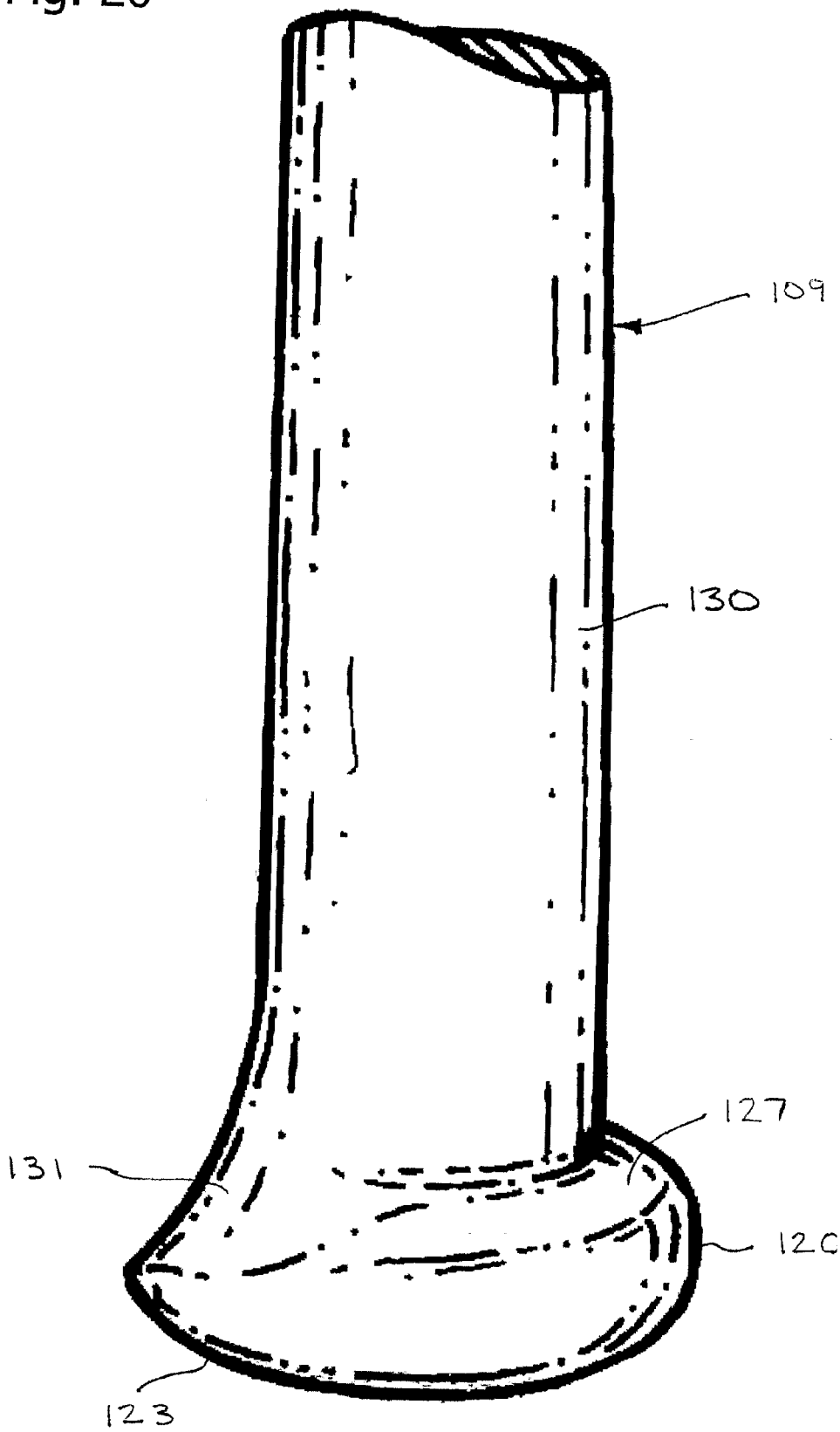
FIG. 20 is an enlarged, fragmentary, right perspective of another embodiment of the present invention.

Referring now to FIG. 20, another embodiment of the present invention is depicted. A bat, generally indicated 109, comprises a handle 130 and a knob 120. The handle 130 is generally cylindrical and is relatively smooth, as with a conventional bat. The interface between the knob 120 and the handle 130 is similar to the embodiments of FIGS. 1 and 12-19. In particular, the knob 120 comprises an end surface 123 extending generally perpendicular to the handle 130 about the circumference of the bat 109. The knob 120 further comprises an upper flange 127 extending generally radially from the handle 130 about a portion (e.g., about half) of the circumference of the knob 120 For this portion of the knob 120, the upper flange 127 and end surface 123 extend laterally outward for some distance and then taper toward one another in a generally longitudinal direction to meet and form the knob. The remainder of the knob 120 does not include an upper flange 127, but rather comprises a smooth support surface 131 extending between the handle 130 and the end surface 123 of the knob 120. The support surface 131 extends from the handle 130 at a relatively shallow angle, compared with the upper flange 127, and is aligned with the grain of the bat such that the batter's grip will properly align with the grain of the bat when grasped, as discussed below. Thus, the support surface 131 extends radially from the handle 130 about as far as the upper flange 127, but does so gradually, reaching its furthermost radial position near the end surface 123 of the knob 120, rather than at the upper flange, as with conventional knobs. In other words, the support surface 131 provides a more gradual transition between the handle 130 and knob 120, thereby providing support for the palmaris brevis and abductor digiti minimi muscles without destabilizing the muscles during a swing of the bat 109. Thus, grip strength is maintained throughout the swing. In one exemplary embodiment, no portion of the support surface 131 extends at an angle greater than about 45 degrees from the handle 130. In another exemplary embodiment, at least a portion of the support surface 131 extends at an angle of less than about 30 degrees from the handle 130. In still another exemplary embodiment, at least a portion of the support surface 131 extends at an angle of less than about 15 degrees from the handle 130. These relatively shallow, acute angles provide a gradual transition between the handle 130 and the knob 120. In still another embodiment, the radius of curvature of the support surface 131 is at least as large as the radius of the generally cylindrical handle 130. This large radius of curvature provides a support surface 131 with a smooth, gentle slope for supporting the hands of the batter.

Figure 21:
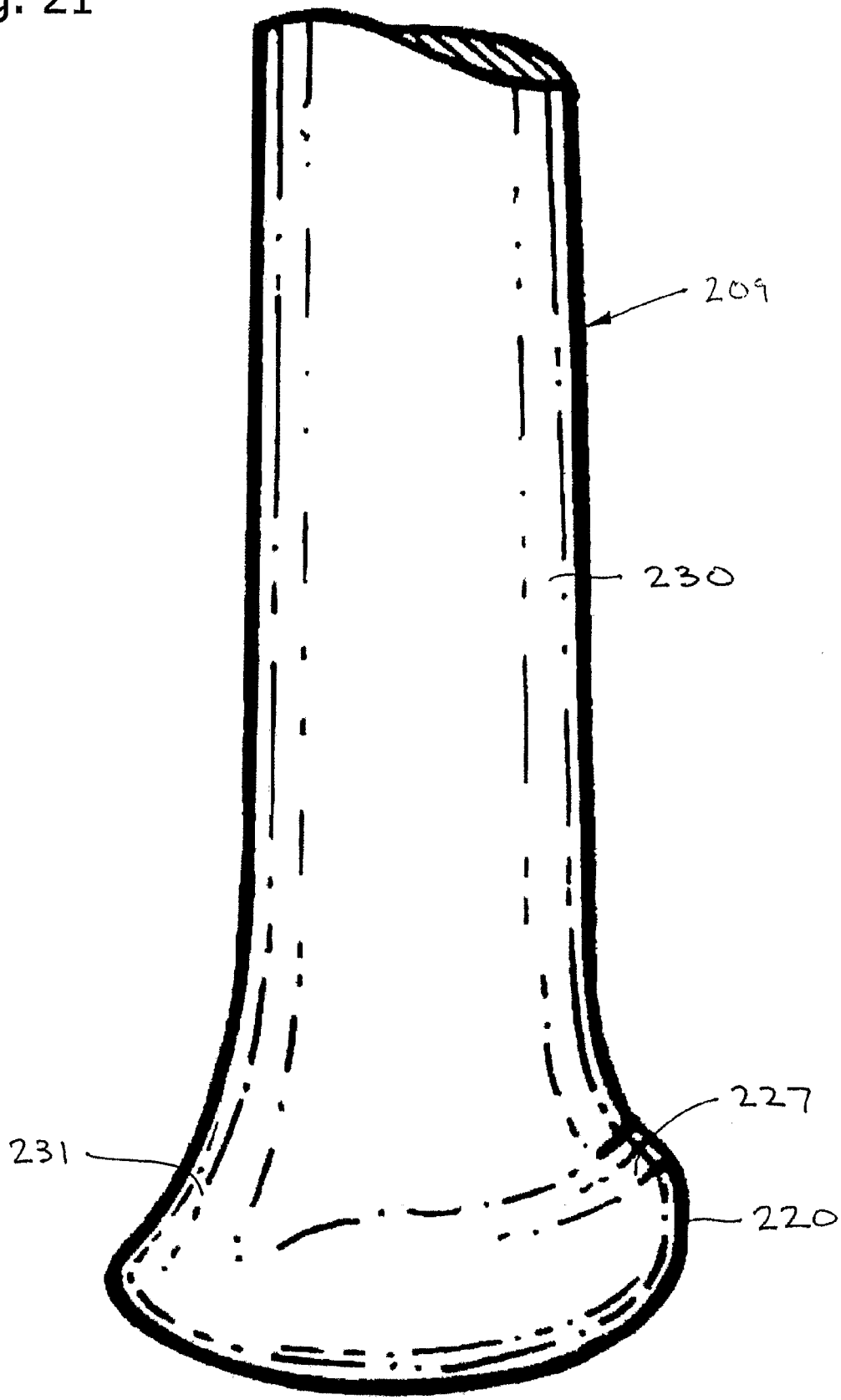
FIG. 21 is an enlarged, fragmentary, right perspective of still another embodiment of the present invention.
Figure 22:
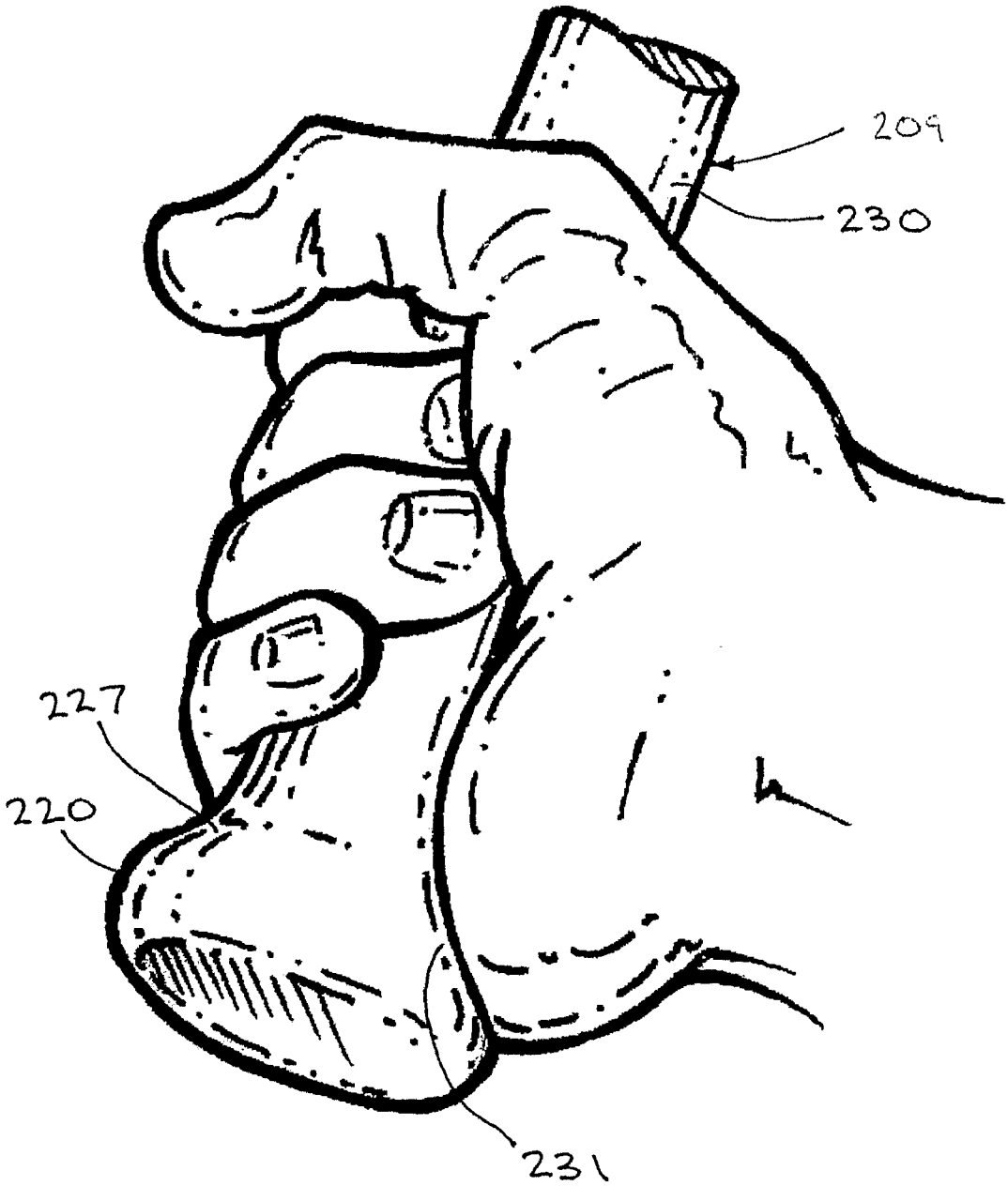
FIG. 22 is an enlarged, fragmentary, front perspective of a left-handed version of the embodiment of FIG. 21 with a batter's hand gripping the left-handed version of the embodiment of FIG. 21.
Figure 23:
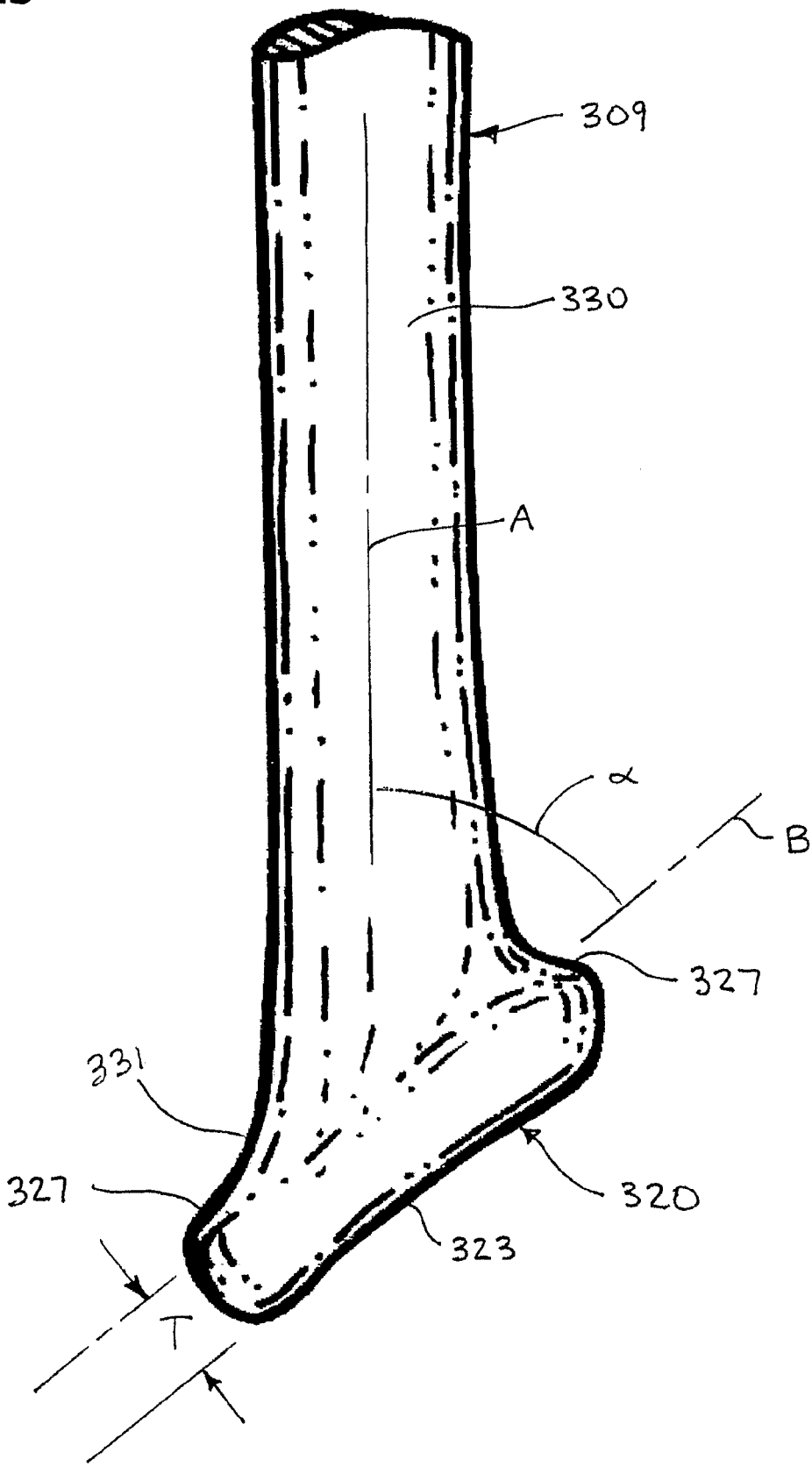
FIG. 23 is an enlarged, fragmentary, right elevation of yet another embodiment of the present invention.

Turning now to FIGS. 21 and 22, another bat embodiment of the present invention is disclosed. A bat, generally indicated 209, comprises a handle 230 ending with a knob 220. The bat 209 further comprises a support surface 231, generally as set forth above with respect to the embodiment of FIG. 20. In contrast with the bat 109 of FIG. 20, however, the upper flange 227 opposite the support surface 231 includes a larger radius fillet that gradually curves from an orientation generally parallel with the bat handle 230 to an orientation generally radial from the handle at the furthermost radial position of the knob 220. The curved upper flange 227 of this embodiment provides a more gradual transition between the handle 230 and knob 220, thereby providing a more comfortable resting place for the batter's fourth digit (i.e., ring finger) or fifth digit (i.e., pinky finger).

Referring now to FIGS. 23-29, still another bat embodiment of the present invention is disclosed. A bat, generally indicated 309, comprises a handle 330 having a central axis A and ending with a knob, generally indicated 320. The knob 320 comprises an end surface 323 and an upper flange 327, each extending generally parallel with an axis B, which is disposed at an angle $\alpha$ relative to axis A. With a conventional baseball bat, the angle $\alpha$ between an axis of the bat handle and an axis of the knob of the bat is about 90 degrees, such that the knob lies at about a 90° angle to the handle. In some embodiments of the present invention, angle $\alpha$ is in a range from about 20 degrees to about 70 degrees. In other embodiments, angle $\alpha$ is in a range from about 40 degrees to about 70 degrees. In the embodiment shown in FIG. 23, angle $\alpha$ is about 50 degrees. Generally, by maintaining axis B at some acute angle, such as between about 0 degrees and about 85 degrees, the knob 320 and handle 330 cooperate to form a support surface 331, generally as set forth above, while maintaining the full thickness T of the knob about the circumference of the bat 309.

As with the previous embodiments, the support surface 331 provides a gradual transition between the handle 330 and knob 320, thereby providing support for the palmaris brevis and abductor digiti minimi muscles without destabilizing the muscles during a swing of the bat 309. Thus, grip strength is maintained throughout the swing. In one exemplary embodiment, no portion of the support surface 331 extends at an angle greater than about 45 degrees from the handle 330. In another exemplary embodiment, at least a portion of the support surface 331 extends at an angle of less than about 30 degrees from the handle 330. In still another exemplary embodiment, at least a portion of the support surface 331 extends at an angle of less than about 15 degrees from the handle 330. These relatively shallow, acute angles provide a gradual transition between the handle 330 and the knob 320. In still another embodiment, the radius of curvature of the support surface 331 is at least as large as the radius of the generally cylindrical handle 330. This large radius of curvature provides a support surface 331 with a smooth, gentle slope for supporting the hands of the batter.

Figure 24:
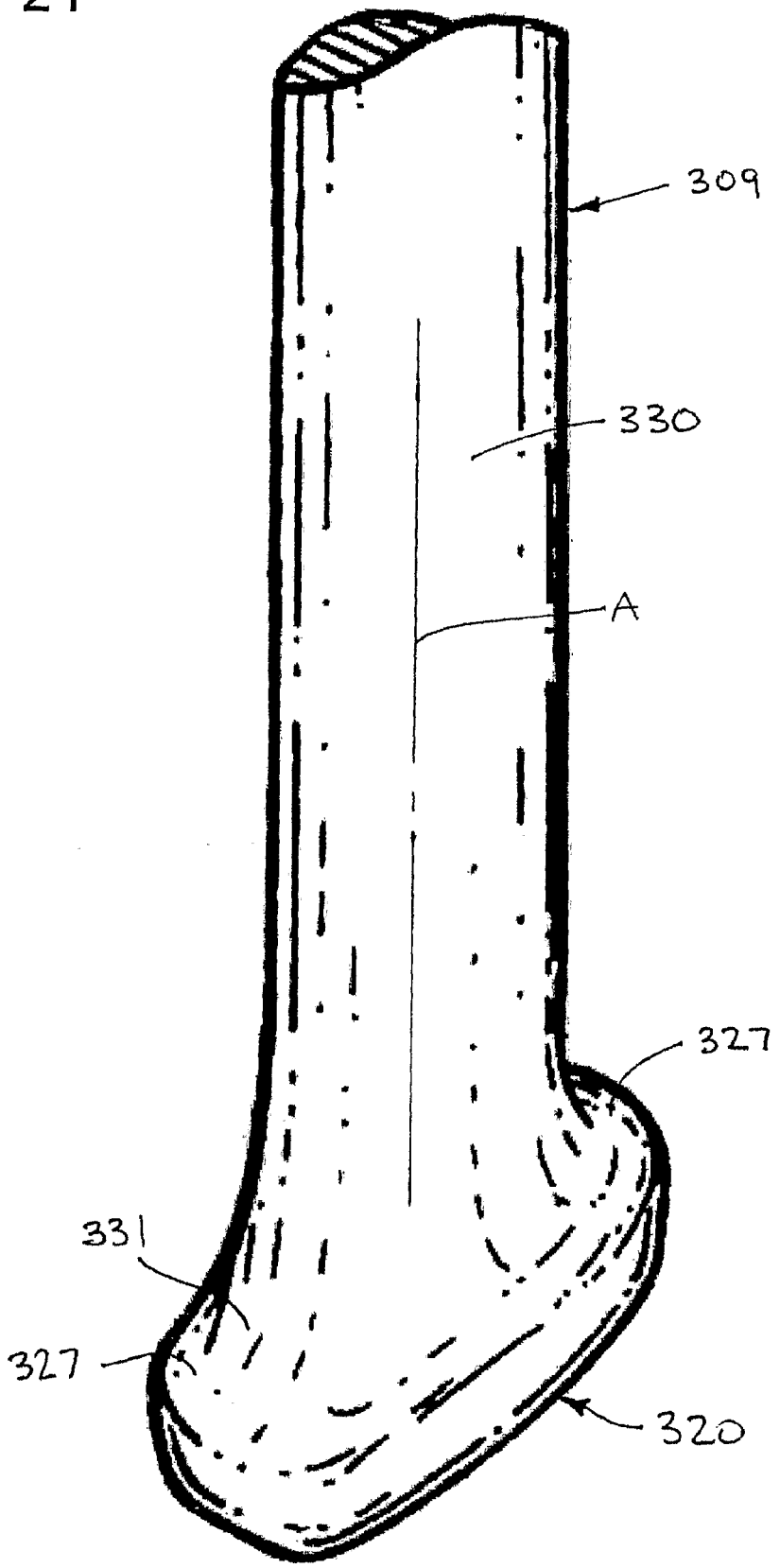
FIG. 24 is an enlarged, fragmentary, front elevation of the embodiment of FIG. 23.
Figure 25:
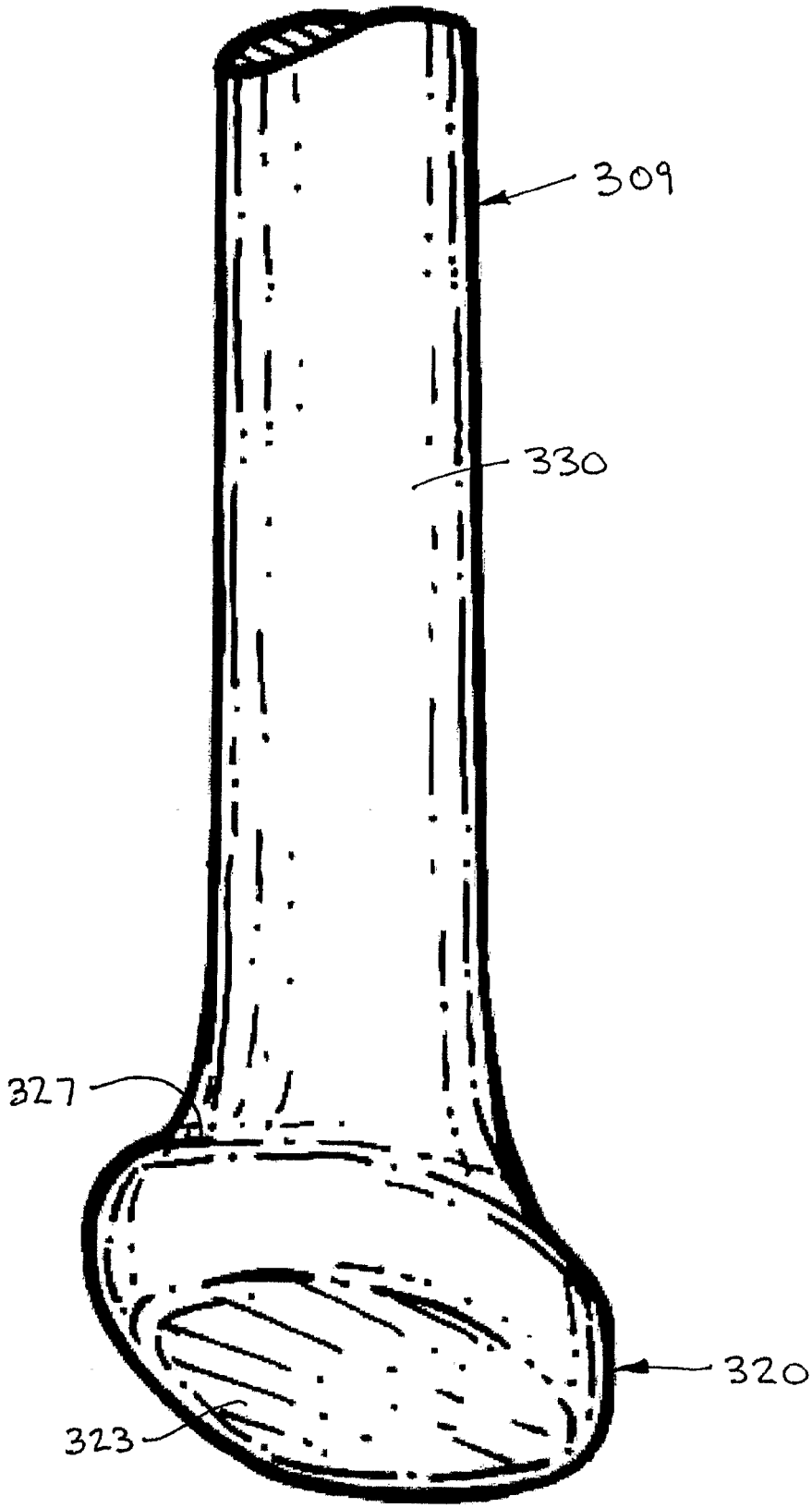
FIG. 25 is an enlarged, fragmentary, rear elevation of the embodiment of FIG. 23.
Figure 26:
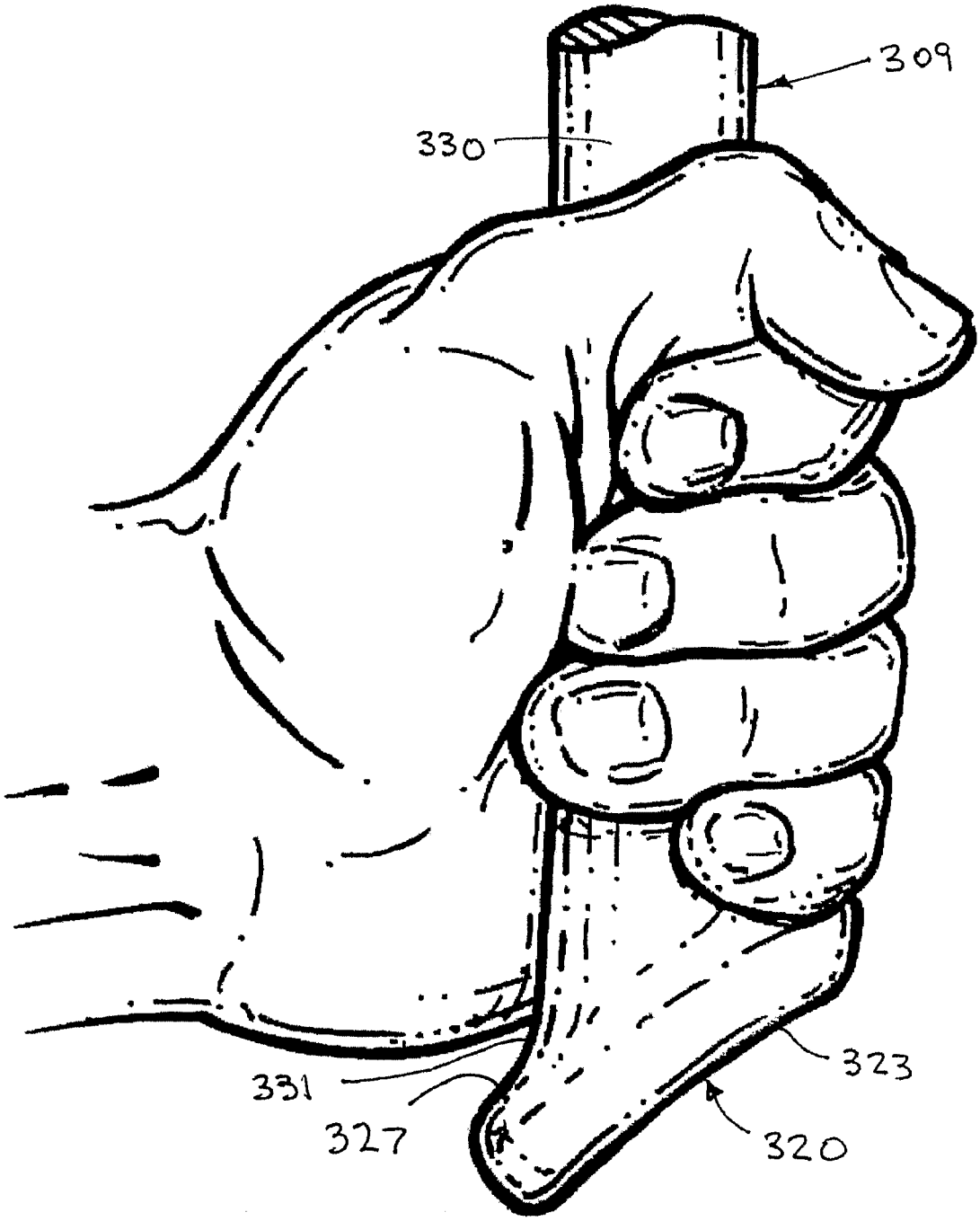
FIG. 26 is an enlarged, fragmentary, right elevation of the embodiment of FIG. 23 with a batter's hand gripping the embodiment of FIG. 23 in an upright, ready position.
Figure 27:
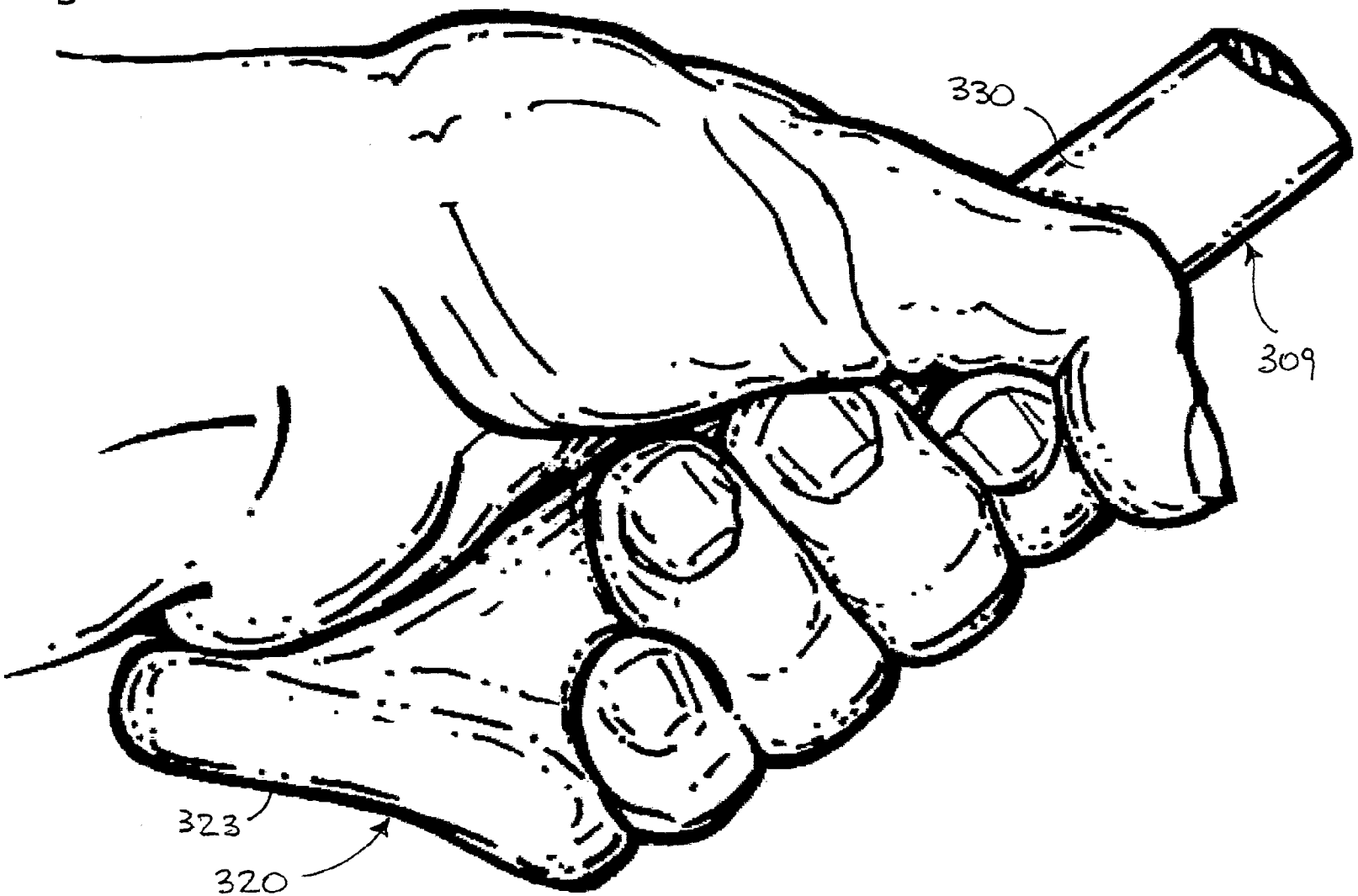
FIG. 27 is an enlarged, fragmentary, right elevation of the embodiment of FIG. 23 with a batter's hand gripping the embodiment of FIG. 23 in a swinging position.
Figure 28:
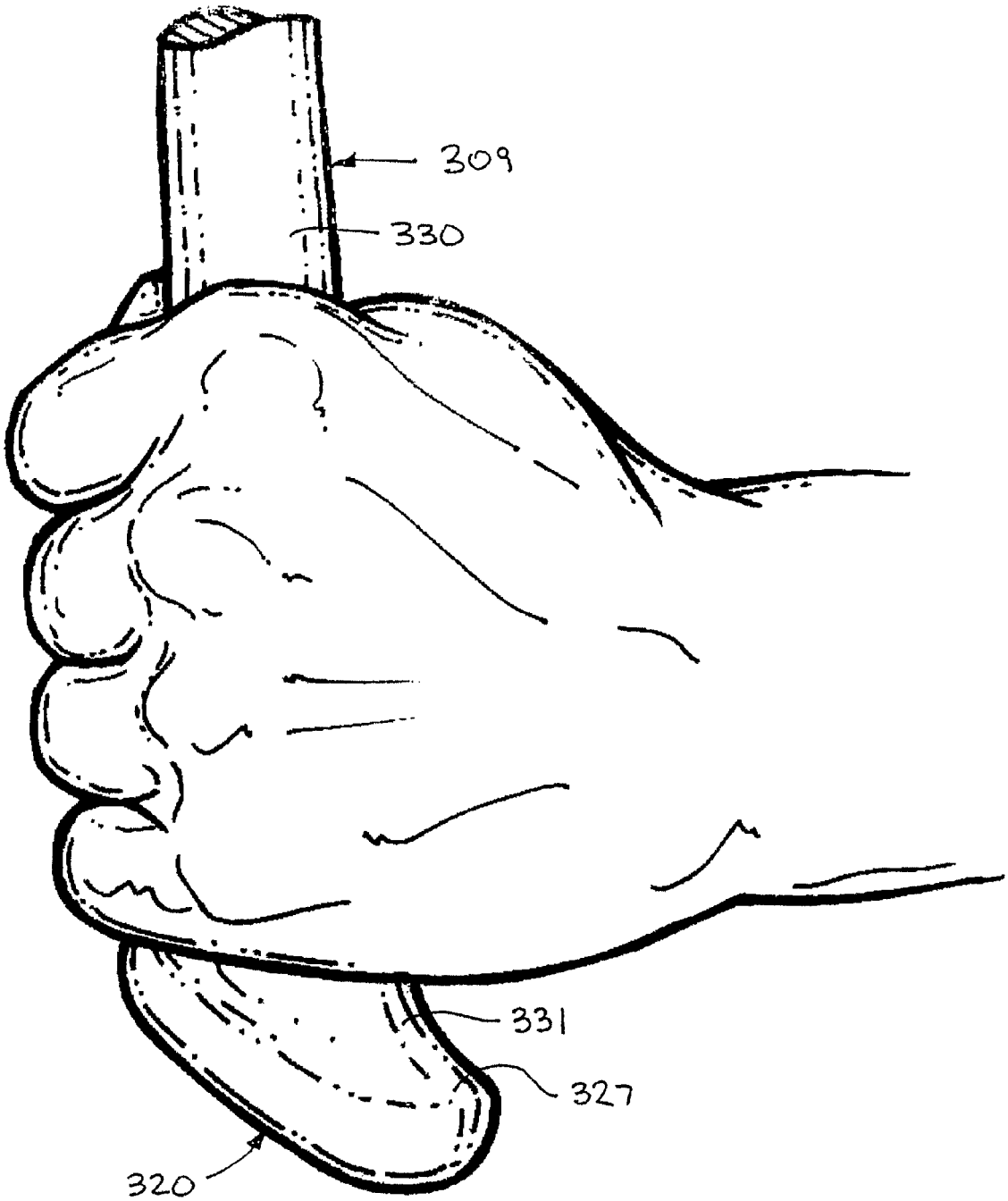
FIG. 28 is an enlarged, fragmentary, left elevation of the embodiment of FIG. 23 with a batter's hand gripping the embodiment of FIG. 23 in an upright, ready position.
Figure 29:
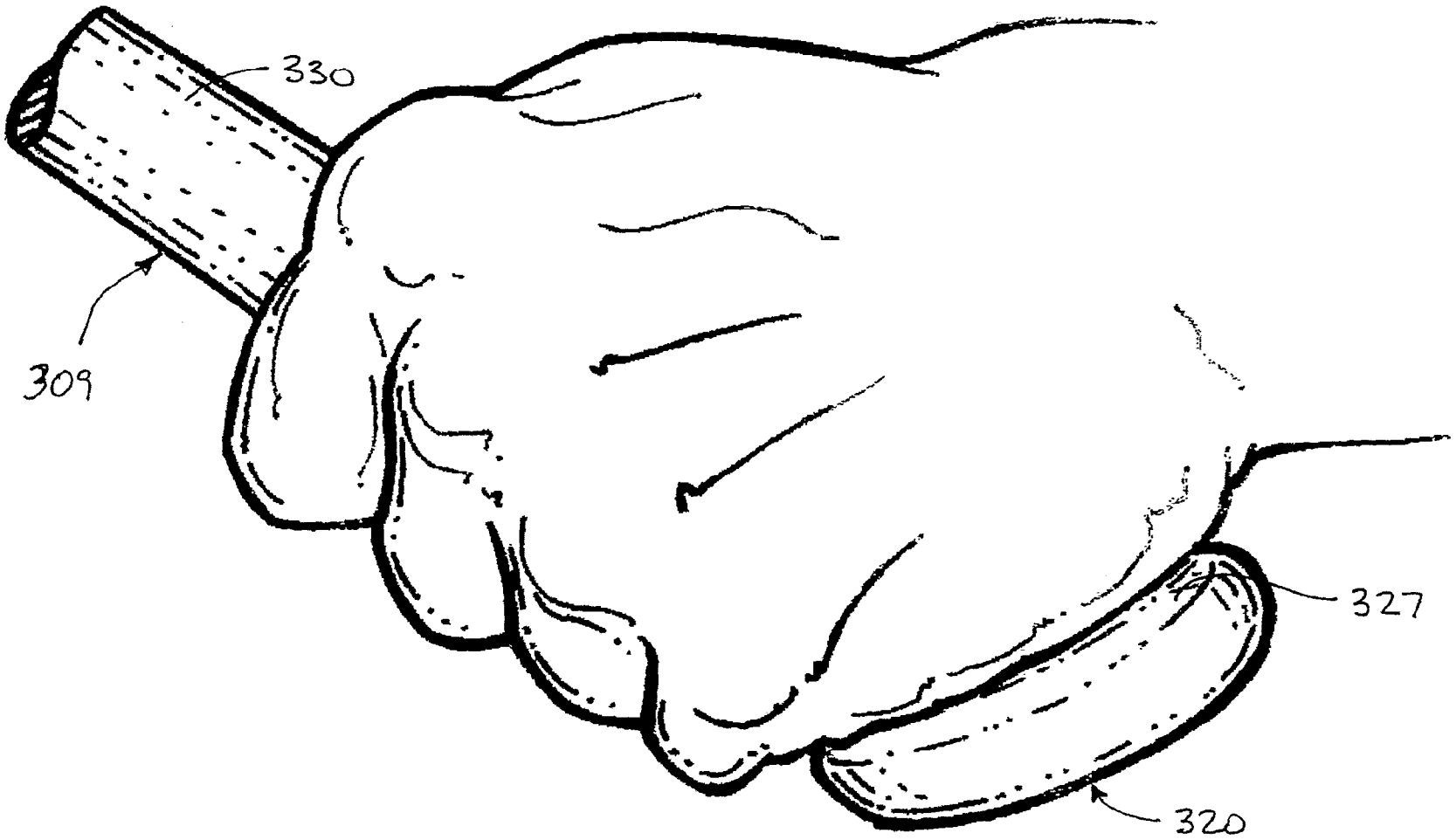
FIG. 29 is an enlarged, fragmentary, left elevation of the embodiment of FIG. 23 with a batter's hand gripping the embodiment of FIG. 23 in a swinging position.

Referring now to FIG. 24, an enlarged, fragmentary, front perspective of the bat 309 is shown. Here, the bat 309 is depicted pivoted about axis A to a position demonstrating the angular orientation of the support surface 331 of the bat for a right-handed batter. In particular, the bat 309 is rotated about axis A to align the support surface 331 with the palmaris brevis and abductor digiti minimi muscles of the lowermost hand (i.e., the left hand) of the batter (see also FIGS. 26-29). For many batters, the rotation of the bat 309 about axis A may be between about 0 degrees and 60 degrees. More particularly, the rotation of the bat 309 about axis A may be between about 30 degrees and about 50 degrees. Even more particularly, the rotation of the bat 309 about axis A may be about 45 degrees. Other angular orientations of the bat 309 about axis A within a batter's hand are also contemplated as within the scope of the claimed invention, including a singular knob orientation that accommodates both left and right-handed grips (e.g., bat rotation of 0 degrees). The batter may readily adjust the angular rotation of the bat 309 about axis A within the batter's hands to an angular position whereby the bat knob 320 and support surface 331 feel most comfortable when the bat is in the swinging position, as depicted in FIGS. 27 and 29. Because of this inherent angular adjustability, the bat 309 is useful for both left and right-handed batters.

Figure 30:
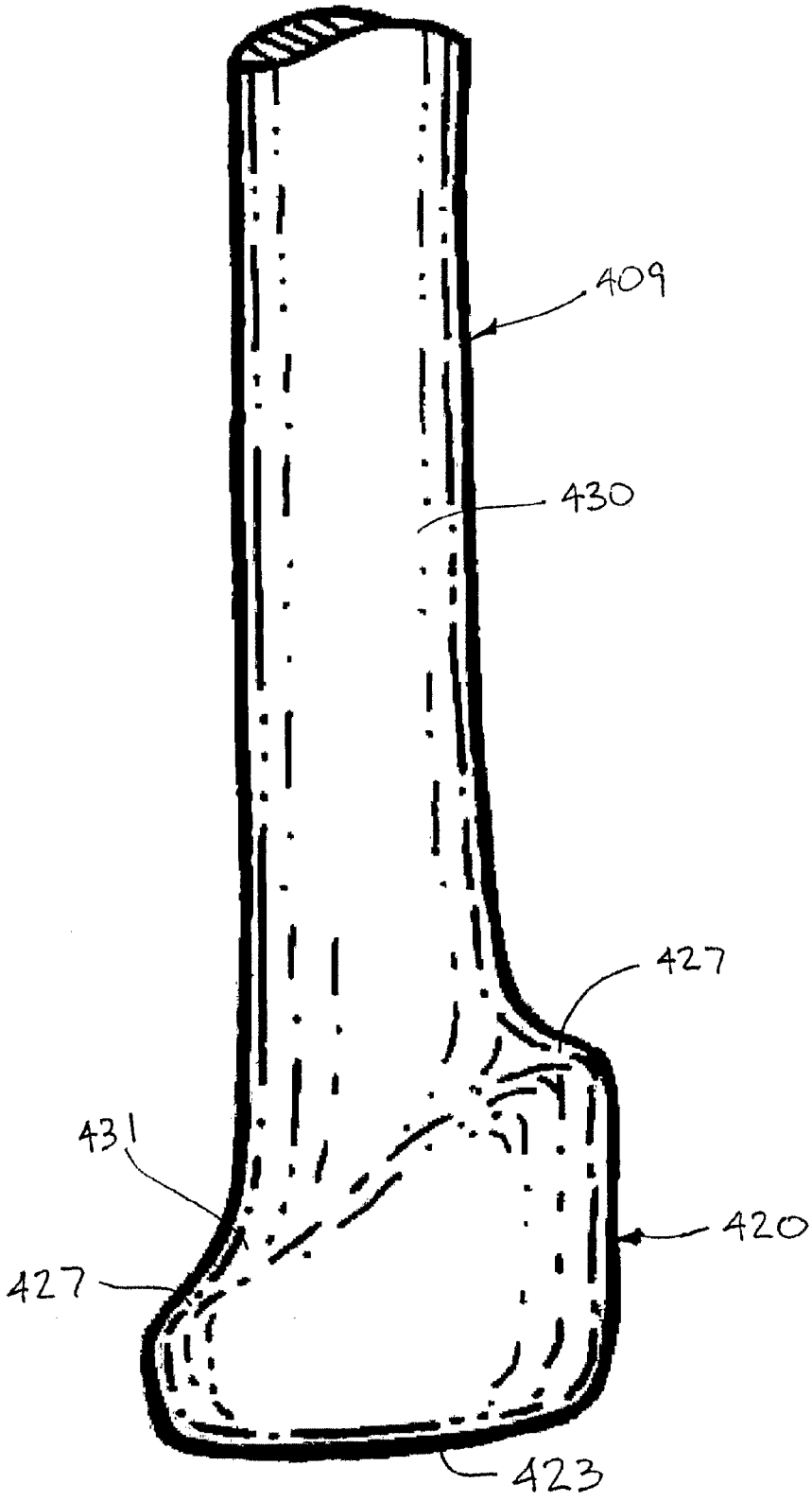
FIG. 30 is an enlarged, fragmentary, right elevation of still another embodiment of the present invention.

Referring now to FIG. 30, a further embodiment of the present invention is disclosed. A bat, generally indicated 409, comprises a handle 430 ending with a knob, generally indicated 420. As with the embodiment of FIGS. 23-29, the knob 420 comprises an upper flange 427 extending generally at a non-90°, or acute, angle to the axis of the handle 430 (e.g. between about 5 degrees and about 85 degrees). Thus, the handle 430 and upper flange 427 cooperate to form a support surface 431, generally as set forth above, for supporting the palmaris brevis and abductor digiti minimi muscles throughout the swing of the batter. The knob 420 of the bat 409 further comprises an end surface 423 oriented at a different angle than the upper flange 427. In the example of FIG. 30, for instance, the end surface 423 is oriented generally perpendicular from the handle 430 of the bat 409. This allows the knob 420 of the bat 409 to have a substantially conventional end surface 423 extending at generally a 90° angle to the handle 430, while the upper flange 427 extends at a non-90° angle (e.g., fifty degrees) to the axis of the handle 430. This bat 409, therefore, incorporates the advantages of the support surface 431 shaped and sized for supporting the palmaris brevis and abductor digiti minimi muscles, while maintaining the end surface 423 of the knob 420 at generally a 90° angle to the handle 430, as with a conventional bat.

Figure 31:
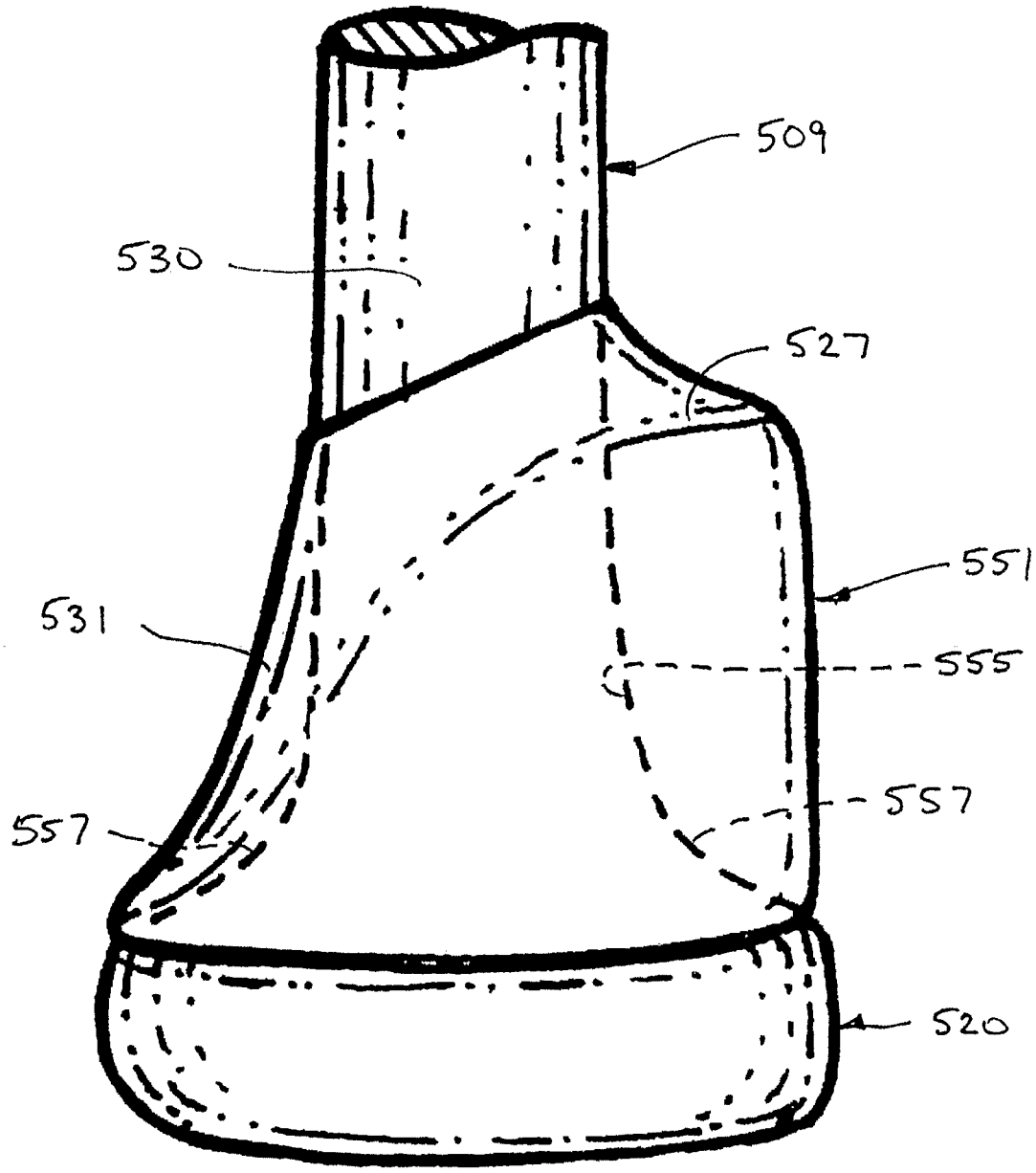
FIG. 31 is an enlarged, fragmentary, right elevation of a support sleeve embodiment of the present invention receiving a conventional bat.
Figure 32:
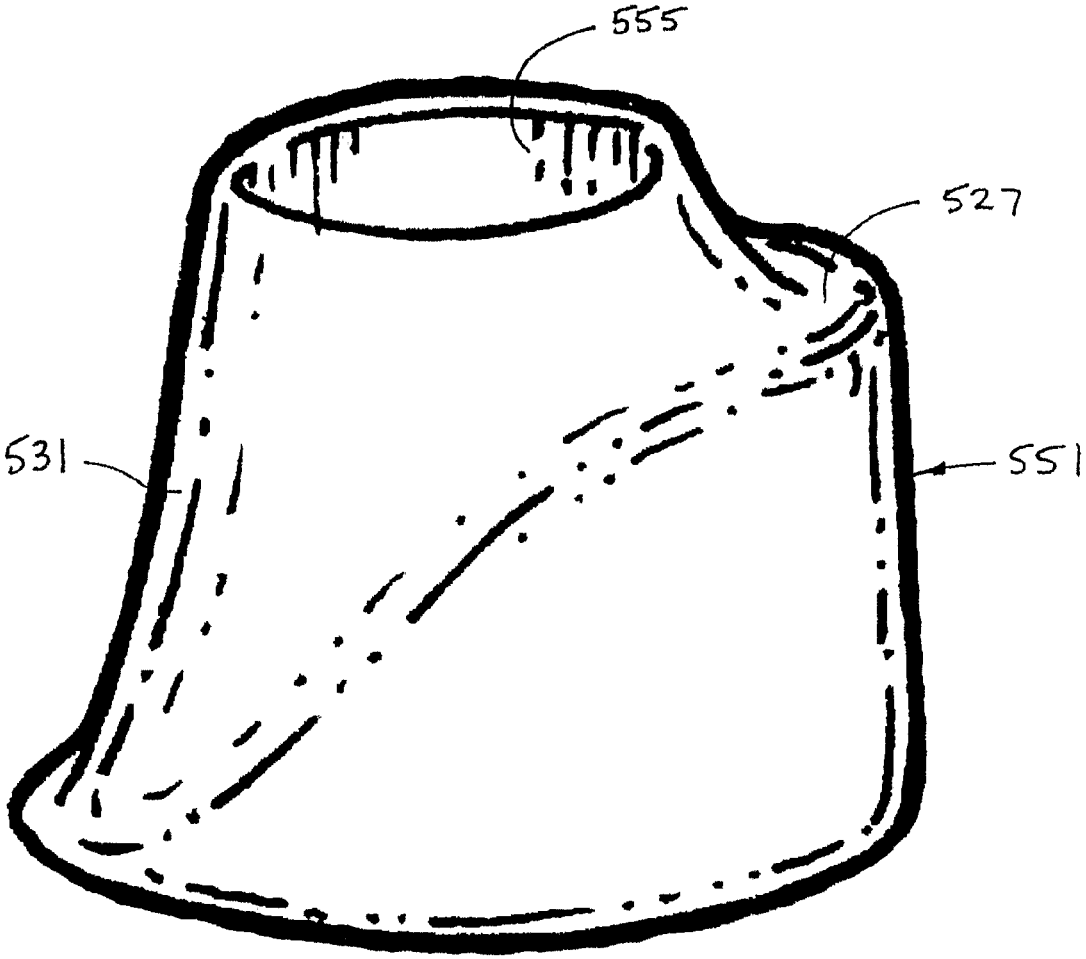
FIG. 32 is a right perspective of the support sleeve of FIG. 31.
Figure 33:
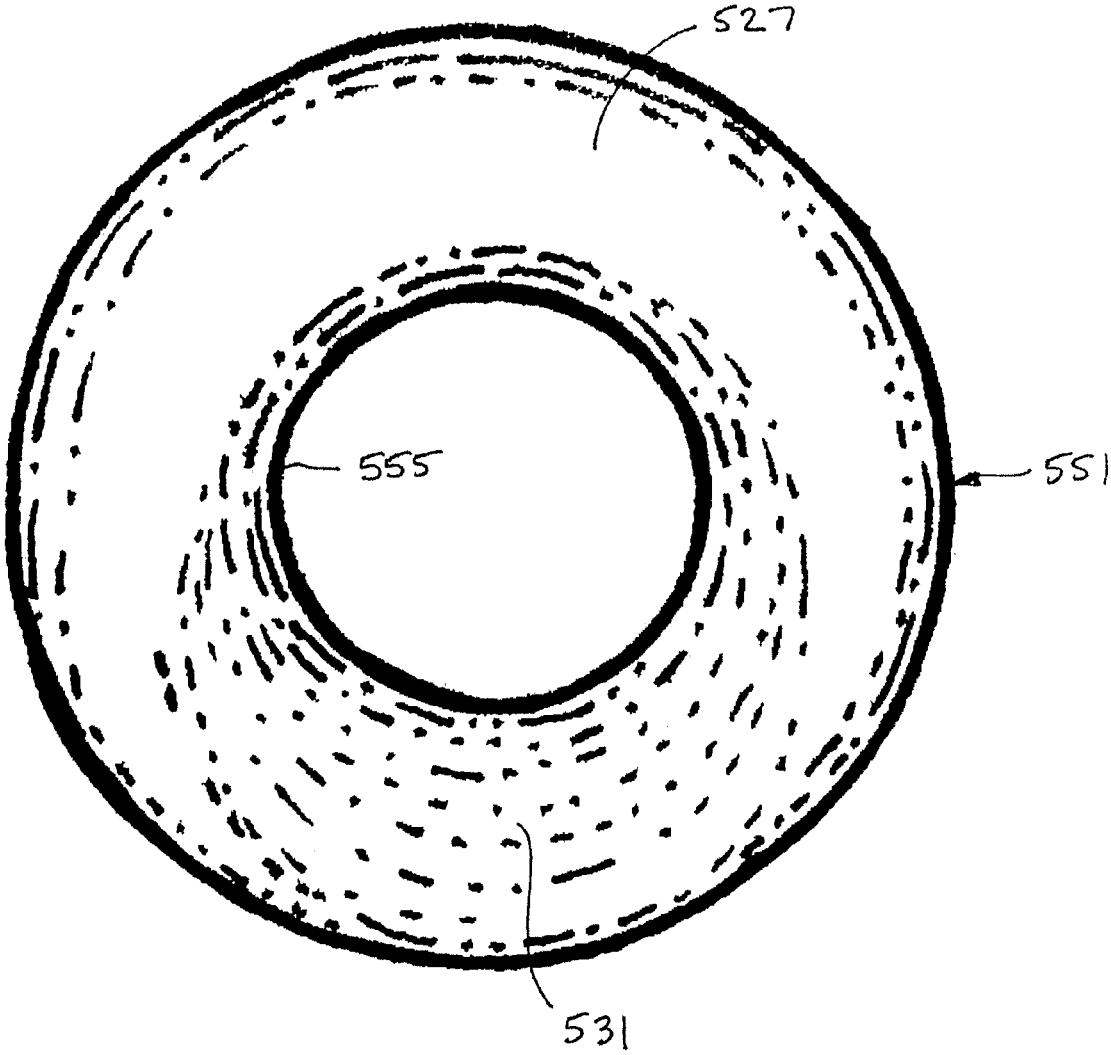
FIG. 33 is a top view of the support sleeve of FIG. 31.

Referring now to FIGS. 31-33, an additional embodiment of the present invention is disclosed. This embodiment comprises a support sleeve, generally indicated 551, adapted to cooperate with a conventional bat, generally indicated 509, to provide the support to a batter's lower hand generally as set forth above with other embodiments of the present invention. In particular, a convention bat 509 comprises a handle 530 ending with a conventional knob, generally indicated 520. The support sleeve 551 includes a bore 555 for receiving the handle 530 of the conventional bat 509. The bore 555 is sized and shaped to corresponding to the portion of the handle 530 directly adjacent the knob 520. In the example shown, the bore 555 is tapered to match the shape of the fillet 557 between the bat handle 530 and knob 520. To fit the handle 530 of the bat 509 within the bore 555 of the sleeve 551, the sleeve may be stretched over the knob 520 of the bat as the knob passes through the bore, or the sleeve may include a slit (not shown) for allowing the bat handle to slip into the bore.

The sleeve 551 further includes a support surface 531, generally as disclosed above, for supporting the palmaris brevis and abductor digiti minimi muscles throughout the swing of the batter. The sleeve 551 is shaped and sized to create the support surface 531 and an upper flange 527, both generally as set forth above with respect to the bat embodiments of FIGS. 23-29 and FIG. 30. For example, in one exemplary embodiment, no portion of the support surface 531 extends at an angle greater than about 45 degrees from the handle 530. In another exemplary embodiment, at least a portion of the support surface 531 extends at an angle of less than about 30 degrees from the handle 530. In still another exemplary embodiment, at least a portion of the support surface 531 extends at an angle of less than about 15 degrees from the handle 530. These relatively shallow, acute angles provide a gradual transition between the handle 530 and the knob 520 of the conventional bat via the sleeve 551. In still another embodiment, the radius of curvature of the support surface 531 is at least as large as the radius of the generally cylindrical handle 530. This large radius of curvature provides a support surface 531 with a smooth, gentle slope for supporting the hands of the batter. As such, the support sleeve 511 may be fitted to a conventional bat 509 to provide the benefits and features of the present invention to the conventional bat.

The sleeve 511 may be constructed of any number of elastic or pliable materials, such as rubber or silicone. The sleeve 511 may also be constructed of a non-pliable material, such as wood or metal, which would require assembly of sleeve portions (e.g., two, three, or more portions) about the handle 530 to form the sleeve.

It is therefore apparent that the present invention discloses an ergonomically superior bat of unique character and performance, which has several features not shown with conventional bats.

What is claimed is:

1. A bat adapted for gripping by the hands of a user and swinging to strike a ball, said bat being a one-piece, smooth round stick not more than 2¾ inches in diameter at the thickest part and not more than 42 inches in length comprising a round cylindrical barrel and a generally cylindrical handle adapted for gripping by said hands of said user, said handle having a linear central axis and ending with a knob, the bat diameter tapering down from the barrel to the handle and then tapering up to the knob at the handle end, the knob comprising an upper flange extending generally parallel with an axis of the knob disposed at an acute angle to the central axis of the handle, the upper flange of the knob and the handle cooperating to form a support surface, the support surface having a radius of curvature at least as large as the radius of the generally cylindrical handle and providing a gradual transition between the upper flange of the knob and the handle for supporting the hand of the user while gripping the implement, wherein the acute angle between the central axis of the handle and the axis of the knob is in a range from 40 degrees to 70 degrees.

2. A bat as set forth in claim 1 wherein the knob further comprises an end surface extending generally parallel to the upper flange and the axis of the knob.

3. A bat as set forth in claim 1 wherein the bat is comprised of wood having a natural grain direction, whereby the support surface is positioned at an angular orientation with respect to the central axis of the handle that is adapted for aligning the bat in the hands of the user when grasped to properly align the grain of the bat such that the grain of the bat is oriented generally parallel to the path of a swing of the user.

4. A bat as set forth in claim 1 wherein the support surface extends partially circumferentially around the handle of the swinging implement.

5. A bat as set forth in claim 1 wherein the thickness of the knob is constant around the circumference of the swinging implement.

6. A bat as set forth in claim 1 wherein at least a portion of said support surface extends at an angle of less than 15 degrees from said handle.

7. A bat adapted for gripping by the hands of a user and swinging to strike a ball, said bat being a one-piece, smooth round stick not more than 2¾ inches in diameter at the thickest part and not more than 42 inches in length comprising a round cylindrical barrel and a generally cylindrical handle adapted for gripping by said hands of said user, said handle having a linear central axis and ending with a knob, the bat diameter tapering down from the barrel to the handle and then tapering up to the knob at the handle end, the knob comprising an upper flange extending generally radially from the handle around a portion of the circumference of the knob and an end surface extending generally perpendicular to the handle around the circumference of the bat, the upper flange and the corresponding portion of the end surface each extending laterally outward from the handle and then tapering toward one another in a longitudinal direction of the bat to meet and form the knob, the remainder of the circumference of the knob comprising a support surface extending from the handle at a shallow angle from the handle, said support surface extending between the handle and the end surface of the knob and having a radius of curvature at least as large as the radius of the generally cylindrical handle for providing a gradual transition between the knob and the handle for supporting the hand of the user while gripping the bat.

8. A bat as set forth in claim 7 wherein the support surface extends radially from the handle about the same radial distance as the upper surface, the support surface reaching its furthermost radial position near the end surface of the knob, thereby providing a more gradual transition from the handle to the knob of the bat.

9. A bat as set forth in claim 8 wherein at least a portion of said support surface extends at an angle of less than about 15 degrees from said handle.

* * * * *